US009799441B2

(12) United States Patent
Kamata

(10) Patent No.: US 9,799,441 B2
(45) Date of Patent: Oct. 24, 2017

(54) TRANSFORMER AND PLASMA GENERATOR

(71) Applicant: Hisahiro Kamata, Kanagawa (JP)

(72) Inventor: Hisahiro Kamata, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/071,667

(22) Filed: Mar. 16, 2016

(65) Prior Publication Data

US 2016/0278197 A1 Sep. 22, 2016

(30) Foreign Application Priority Data

Mar. 19, 2015 (JP) ..... 2015-056968
Mar. 20, 2015 (JP) ..... 2015-058796
Feb. 22, 2016 (JP) ..... 2016-031200

(51) Int. Cl.

*H01F 27/06* (2006.01)
*H01F 27/02* (2006.01)
*H01F 27/32* (2006.01)
*H01F 5/06* (2006.01)
*H01F 27/28* (2006.01)
*H05H 1/46* (2006.01)

(52) U.S. Cl.

CPC ..... *H01F 27/323* (2013.01); *H01F 27/02* (2013.01); *H01F 27/2804* (2013.01); *H01F 27/2823* (2013.01); *H01F 2027/2809* (2013.01); *H05H 2001/4682* (2013.01)

(58) Field of Classification Search

None

See application file for complete search history.

(56) References Cited

U.S. PATENT DOCUMENTS 4,276,530 A * 6/1981 Benke ..... H01F 27/18 165/104.27
5,766,517 A * 6/1998 Goedde ..... H01F 27/12 252/570
2003/0132825 A1 7/2003 Gamou
2006/0125593 A1* 6/2006 Piaskowski ..... H01F 27/085 336/229
2007/0205727 A1* 9/2007 Tamita ..... C01B 13/11 315/291
2009/0243782 A1 10/2009 Fouquet et al.
2011/0235382 A1 9/2011 Kamata
2012/0163058 A1 6/2012 Kamata
2012/0236614 A1 9/2012 Kamata
2014/0265911 A1 9/2014 Kamata et al.
2014/0268966 A1 9/2014 Kamata (Continued)

FOREIGN PATENT DOCUMENTS

JP 11-297557 10/1999
JP 2002-270437 9/2002

(Continued)

OTHER PUBLICATIONS

U.S. Appl. No. 14/853,427, filed Sep. 14, 2015.

*Primary Examiner* — Dedei K Hammond
(74) *Attorney, Agent, or Firm* — Oblon, McClelland, Maier & Neustadt, L.L.P.

(57) ABSTRACT

A transformer includes: a first winding; a second winding provided to maintain a first distance to the first winding; and a shell that seals the first winding and the second winding.

13 Claims, 22 Drawing Sheets

(56) References Cited

U.S. PATENT DOCUMENTS

| | | | |
|---|---|---|---|
| 2015/0200606 | A1 | 7/2015 | Nunokawa et al. |
| 2015/0271906 | A1 | 9/2015 | Kamata |

FOREIGN PATENT DOCUMENTS

| | | |
|---|---|---|
| JP | 2005-005595 | 1/2005 |
| JP | 2009-283771 | 12/2009 |
| JP | 2010-212669 | 9/2010 |
| JP | 2012-135112 | 7/2012 |

* cited by examiner

TRANSFORMER AND PLASMA GENERATOR

CROSS-REFERENCE TO RELATED APPLICATIONS

The present application claims priority to and incorporates by reference the entire contents of Japanese Patent Application No. 2015-056968 filed in Japan on Mar. 19, 2015, Japanese Patent Application No. 2015-058796 filed in Japan on Mar. 20, 2015 and Japanese Patent Application No. 2016-031200 filed in Japan on Feb. 22, 2016.

BACKGROUND OF THE INVENTION

1. Field of the Invention

The present invention relates to a transformer and a plasma generator.

2. Description of the Related Art

Atmospheric-pressure plasmas are used as a way of surface treatment in various applications, such as modification of and contamination removal from surfaces. In the case of applying, for example, bonding, printing, or coating to a resin material, preprocessing the material using an atmospheric-pressure plasma can improve wettability of a surface to be subjected to the application. This improvement allows the bonding, printing, or coating process to be favorably applied.

Generating the atmospheric-pressure plasma requires a high voltage, so that an inverter device needs to efficiently apply the high voltage and supply generated radical species to a load in a stable manner. In general, a plasma generator uses a high-voltage inverter device that provides an alternating-current output with an output voltage of ten-odd kilovolts or higher and an output power of several tens of watts or higher. A transformer used in such a high-voltage inverter device often employs an approach, such as increasing the number of turns of winding or dividing an output side winding, so as to obtain a sufficient magnetic flux density. Japanese Patent Application Laid-open No. 2012-135112 discloses a transformer that has divided output windings, and is provided with insulation layers of a flame-retardant tape between layers of the respective divided windings.

Providing insulating materials between the respective layers of the divided windings of the transformer increases the area occupied by the insulation layers between the windings by an amount corresponding to the division into the windings, leading to an increase in distributed capacitance. The high output voltage requires the number of turns be large, and, in addition, the distributed capacitance increases, so that the self-resonant frequency of the transformer decreases, and, from the viewpoint of the output, the frequency bandwidth of the output inductance of the transformer decreases. This causes the problem that the control range of the switching frequency decreases.

In view of the above, there is a need to provide a transformer that is capable of having a higher self-resonant frequency.

SUMMARY OF THE INVENTION

It is an object of the present invention to at least partially solve the problems in the conventional technology.

A transformer includes: a first winding; a second winding provided to maintain a first distance to the first winding; and a shell that seals the first winding and the second winding.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

The following describes details of embodiments of a transformer and a plasma generator according to the present invention, with reference to the accompanying drawings.

Figure 1:
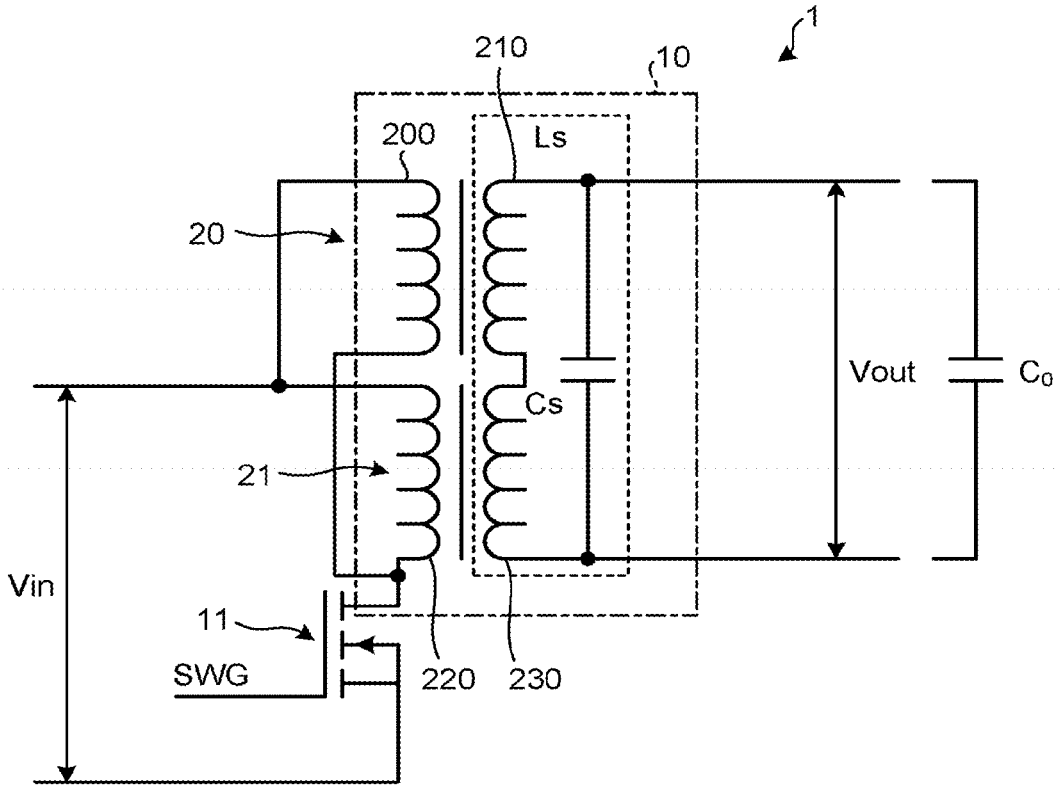
FIG. 1 is a circuit diagram illustrating an example circuit in which a transformer according to embodiments of the present invention can be used.

FIG. 1 illustrates an example circuit in which a transformer according to the embodiments can be used. FIG. 1 illustrates an example of a resonant circuit of an inverter device. In FIG. 1, this resonant circuit 1 includes a transformer 10 and a switching element 11. The resonant circuit 1 forms a voltage resonant circuit including output inductance Ls of the transformer 10 and electrostatic capacitance Cs distributed in or parasitic to an output winding (secondary winding) of the transformer 10.

The resonant circuit 1 modulates an input voltage Vin as a direct-current voltage into, for example, a pulse-width modulated (PWM) signal using a switching operation of the switching element 11 according to a switching signal SWG, then supplies the modulated signal to an excitation winding (primary winding) of the transformer 10, and outputs an output voltage Vout alternating at a high voltage from the output winding of the transformer 10. The output of the transformer 10 is supplied to, for example, a passive component having electrostatic capacitance $C_0$.

The passive component supplied with the output of the transformer 10 is, for example, an atmospheric-pressure plasma generator that includes a discharge electrode, a counter electrode, and a dielectric material. The transformer 10 in the example of FIG. 1 has the following configuration: the excitation winding is divided into windings 200 and 220, and the output winding (secondary winding) is divided into windings 210 and 230, so that the transformer 10 is divided, in terms of the current therethrough, into two transformers 20 and 21 sharing a magnetic flux.

In general, an atmospheric-pressure plasma is generated at a normal atmospheric pressure level and at a voltage of 6 kilovolts (kV) or higher. A load between the two electrodes for generating the plasma is determined corresponding to the electrostatic capacitance $C_0$ of the passive component, and electrostatic capacitance C on the output side of the resonant circuit 1 is determined by the constants Ls, Cs, and $C_0$ in the resonant circuit 1.

The output waveform of the output voltage Vout is formed by adding distortion components to a fundamental wave, the distortion components being generated by, for example, an influence of a magnetic field on the electrical path of the resonant circuit 1 and changes in the constants of the resonant circuit 1 due to a temperature change and a shift in length between wires. The output waveform is decomposed into higher order, alternating, attenuated waveforms by, for example, being expanded into Fourier series.

The constants Ls and Cs of the resonant circuit 1 represent combined properties of a plurality of transformers (such as the transformers 20 and 21 of FIG. 1) having magnetic paths separate from each other. When the number of the divided transformers is two, each of the transformers has output inductance of substantially Ls/2 and output capacitance of substantially Cs/2 without load capacitance. The output voltage Vout is an alternating voltage. In the case of the application for generating the plasma, the output voltage Vout has a value of several kilovolts to several tens of kilovolts, yielding a mean output power of several watts to several tens of kilowatts.

In general, a device yielding an output power value of several watts (W) is often used as the inverter device. A high-voltage inverter device yielding an alternating-current output of ten-odd kilovolts in output voltage and several tens of watts in power value is used, for example, in the plasma generator.

In such a high-voltage inverter device, the transformer needs to have the windings of a larger number of turns in order to compensate for a lack in magnetic flux density. The larger number of turns increases distributed capacitance between windings and between respective layers of the windings in the transformer, and the distributed capacitance causes the transformer to be more vulnerable to water molecules. As a result, impurities in the atmosphere prevent the transformer from maintaining a uniform electric field, and an electrical path other than an original path is generated, which serves as cause of leakage in the transformer.

The distributed capacitance between the windings and between the respective layers of the windings also causes a reduction in the self-resonant frequency $f_0$. As a result, a resonance occurs at or below a switching frequency to be used by the transformer, so that a problem occurs that a usable switching frequency decreases. Because of the problems described above, the parallel resonance of the electrostatic capacitance C and the output inductance Ls may be employed to reduce the burden in the number of turns, as in the case of the transformers 20 and 21 of FIG. 1.

However, in view of the problems described above, such a method has the following three problems (1) to (3).

(1) A switching frequency $f_s$ used needs to be equal to or lower than the self-resonant frequency $f_0$ of the transformer. For example, in the case of using the PWM control, a range of time ratio limits the frequency of the output resonant state to a range between the switching frequency $f_s$ and the self-resonant frequency $f_0$. In the case of using pulse frequency modulation (PFM) control, a frequency modulation is performed, so that the switching frequency $f_s$ is equal to an output resonant frequency, and the time ratio is 0.5. However, to achieve a resonant state, the characteristics of the output inductance Ls need to be in the positive region, so that the limiting condition is the same as that of the PWM control.

(2) The output voltage Vout is an alternating voltage, so that, for example, electric discharges are likely to occur between the individual windings. These discharges may generate pinholes in a part of a skin (insulating material such as enamel) of a winding of the transformer to degrade insulation properties (durability). Even if the transformer can be used for a long time, the function and performance thereof may be degraded, or the reliability, such as the insulation properties, may become insufficient.

(3) In the case of performing an atmospheric-pressure discharge, consideration need to be taken for a pressure change of the environment caused by external changes in environment, such as the weather and the altitude. That is, in the atmospheric-pressure discharge, it is known from Paschen's law and a state equilibrium equation that a change in atmospheric pressure changes the sparkover voltage. Specifically, when the product of the pressure and the volume is constant, the sparkover voltage increases as the pressure (atmospheric pressure) decreases. The change in the atmospheric pressure may change the value of the distributed capacitance under the influence of the water molecules in the transformer. In this case, the self-resonant frequency $f_0$ of the transformer changes with the change in the distributed capacitance, resulting in a change in the output voltage Vout.

In view of the problems (1) to (3), the embodiments provide a transformer that can reduce the variation in the self-resonant frequency $f_0$ relative to a variation in the load, and that can increase the bandwidth of the usable switching frequency $f_s$. Moreover, the embodiments provide the transformer that reduces, when outputting a high voltage, the electric discharges in the transformer, in particular, the electric discharges in the transformer caused by a change in the external environment, so as to further improve the reliability.

Structure of Transformer According to First Embodiment

The following describes a structure of a transformer according to a first embodiment of the present invention. The transformer according to the embodiment has a structure in which a primary winding and a secondary winding constituting the transformer are sealed in one shell. The term "sealed" means that the shell is configured such that a gas does not move between the interior and the exterior of the shell. The sealed shell is not provided therein with a solid insulating material (insulating tape) wound around the respective primary and secondary windings. Each of the primary and secondary windings is arranged to maintain predetermined distances to the adjacent structure in the sealed shell. Furthermore, after containing the primary and secondary windings, the water molecules are discharged from the shell, which is then sealed.

The transformer of the first embodiment has such a structure. Hence, the leakage by the water molecules and the electric discharges are prevented; the influence of the external environment is reduced; the output can be maintained in a stable manner; and the reliability is improved. No solid insulating material is used between the windings, between the layers of the windings, or between the windings and the container, but air is used as an insulating material. Hence, a specific permittivity of substantially 1 is obtained, so that the dielectric loss is reduced and the distributed capacitance can be reduced. As a result, a higher value of the self-resonant frequency $f_0$ can be obtained, and the frequency bandwidth of the output inductance Ls of the transformer increases, so that a higher switching frequency can be used.

Figure 2:
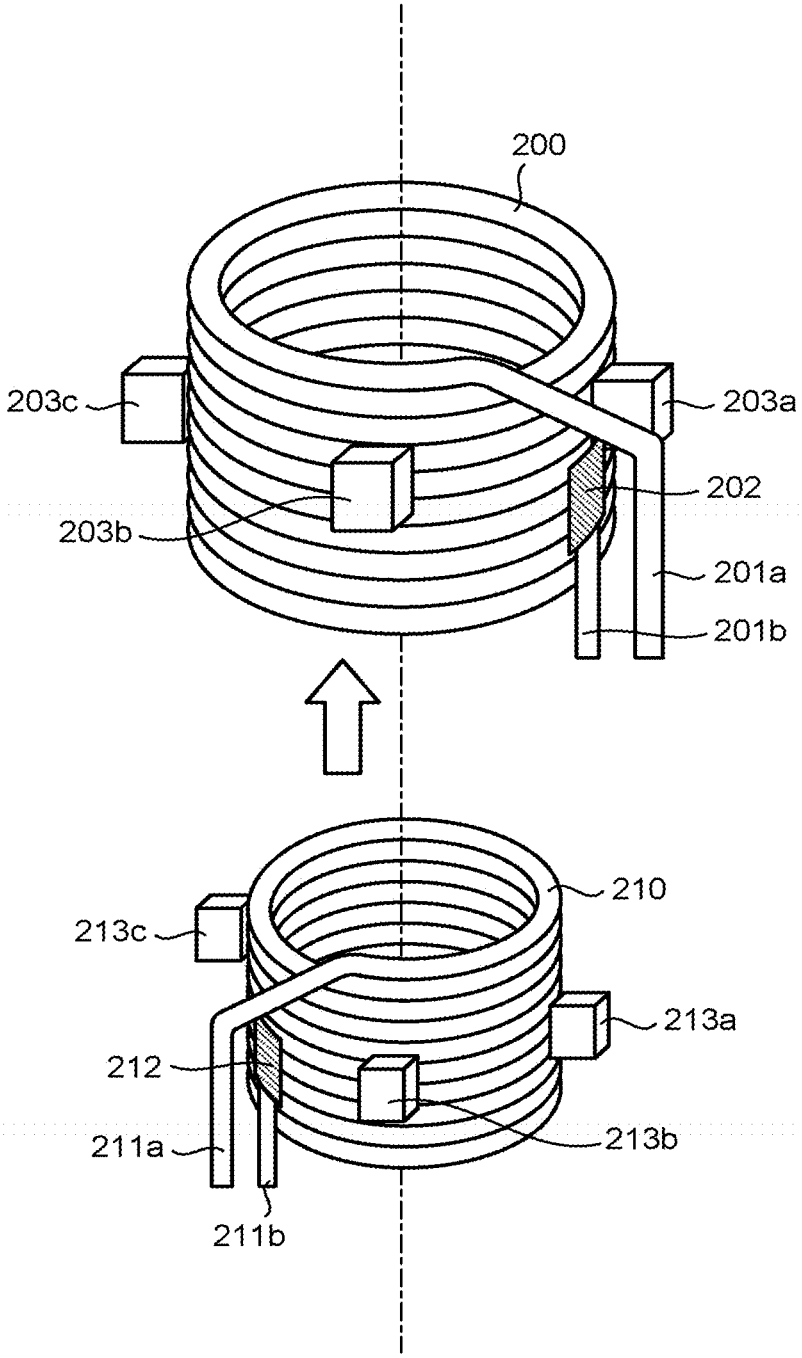
FIG. 2 is a view for more specifically explaining a transformer according to a first embodiment of the present invention.

The following more specifically describes the transformer according to the first embodiment, using FIGS. 2 to 6. FIG. 2 illustrates examples of the primary and secondary windings of the transformer according to the first embodiment. In FIGS. 2 to 6, portions common to those in FIG. 1 explained above are given the same reference numerals as in FIG. 1, and detailed description thereof will not be given.

FIG. 2 illustrates the examples of the windings 200 and 210 included in the transformer 20 that is obtained by dividing the transformer 10 of FIG. 1. The upper part of FIG. 2 illustrates the example of the winding 200 serving as the primary winding, and the lower part thereof illustrates the winding 210 serving as the secondary winding. FIG. 2 illustrates the windings 200 and 210 as examples of two necessary minimum windings for constituting a transformer.

The winding 210 is formed by winding a wire insulated by enamel or the like into a cylindrical form, and is bent at both ends thereof to form lead wires 211*a* and 211*b*. In this example, the lead wires 211*a* and 211*b* are drawn out toward the lower side of the winding 210, and an insulating material 212 is inserted at a location on a winding portion of the winding 210 corresponding to the lead wire 211*a* that is bent and drawn out from the upper end of the cylinder formed by the winding 210. The insulating material 212 is formed by pasting, for example, a flame-retardant insulating tape having as small an area as possible to the winding portion.

Parts of the outer circumference of the winding 210 are provided with bridges 213*a*, 213*b*, and 213*c*. The bridges 213*a*, 213*b*, and 213*c* are provided to ensure a spatial distance to a structure on the outer circumferential side of the winding 210. The bridges 213*a*, 213*b*, and 213*c* have a thickness that can maintain the spatial distance and a creepage distance necessary for providing an electrical insulation in the radial direction of the winding 210. A material having high insulation properties, a low specific permittivity and a low dielectric tangent is selected as a material of the bridges 213*a*, 213*b*, and 213*c*. Examples of such a material include, but are not limited to, glass and resins.

While the three bridges 213*a*, 213*b*, and 213*c* are provided in FIG. 2, the present invention is not limited to this example. Two or four or more bridges may be provided.

The winding 200 illustrated in the upper part of FIG. 2 is formed by winding a wire insulated by enamel or the like into a cylindrical form having a radius larger than that of the winding 210. The radius of the winding 200 is set to, for example, a value obtained by adding the thickness of the bridges 213*a*, 213*b*, and 213*c* in the radial direction of the winding 210 to the radius of the winding 210. The winding 200 may have a still larger radius.

The configuration of the winding 200 other than the above is substantially the same as that of the winding 210. Specifically, lead wires 201*a* and 201*b* are bent and drawn out from the upper end and the lower end, respectively, of the cylinder formed by the winding 200. An insulating material 202 is inserted at a location on a winding portion of the winding 200 corresponding to the lead wire 201*a* that is drawn out from the upper end of the cylinder. In addition, in the same manner as in the case of the winding 200 described above, parts of the outer circumference of the winding 200 are provided with bridges 203*a*, 203*b*, and 203*c* having a thickness that can maintain a spatial distance and a creepage distance necessary for providing an electrical insulation in the radial direction of the winding 200.

In general, the windings 200 and 210 are automatically wound using equipment, and are preferably impregnated with a resin, made thermoadhesive, or made thermosetting so as to be prevented from coming loose after being wound.

Figure 3:
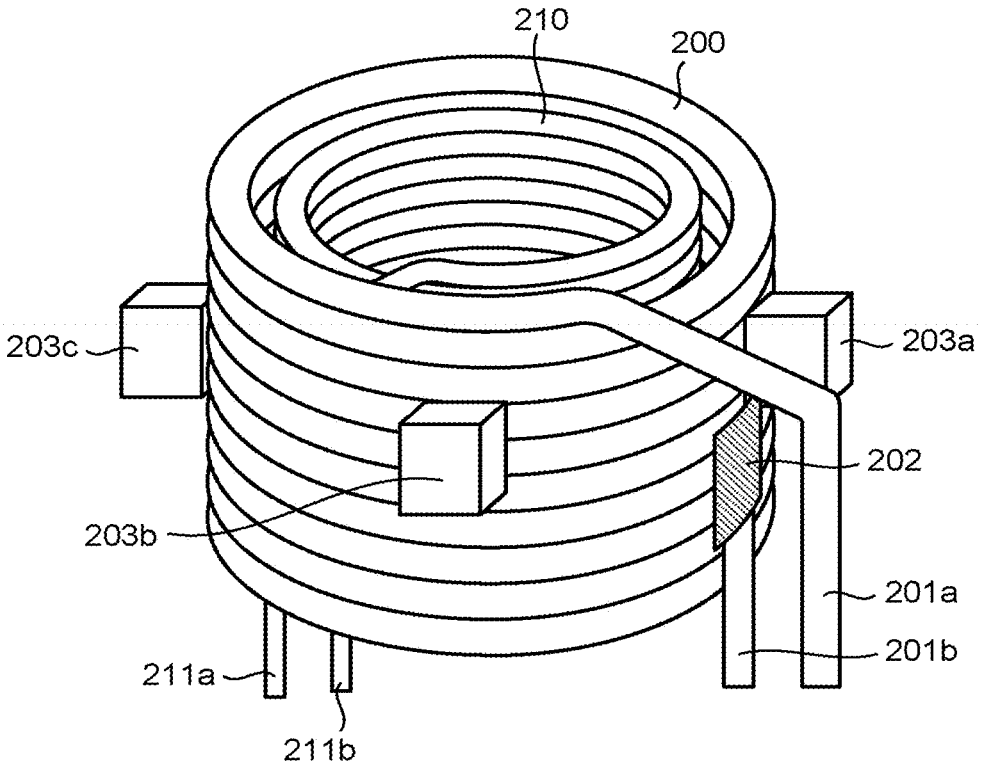
FIG. 3 is another view for more specifically explaining the transformer according to the first embodiment.

As indicated by an arrow in FIG. 2, the winding 210 is embedded in the inner circumference of the winding 200. FIG. 3 illustrates the state in which the winding 210 is embedded in the inner circumference of the winding 200. The bridges 213*a*, 213*b*, and 213*c* maintain the appropriate spatial distance between the windings 210 and 200. The combination of the windings 210 and 200 provides an air-core transformer.

In the state in which the winding 210 is embedded in the inner circumference of the winding 200, for example, the bridges 213*a* and 213*c* are preferably provided so as not to be contained in a plane containing the bridges 203*a* and 203*c* that is orthogonal to the direction of the magnetic flux in the winding 200. In the example of FIG. 2, the bridges 213*c* and 213*a* are provided in positions shifted upward and downward, respectively, in the direction of the magnetic flux from the plane containing the bridges 203*a* and 203*c*. In this manner, the bridges 213*a* and 213*c* are also provided so as to be contained in planes different from each other that are orthogonal to the direction of the magnetic flux in the winding 200. In the same manner, the bridge 213*b* is also provided so as to be shifted downward from the bridge 203*b*.

While the above description has exemplified that the windings 200 and 210 are the primary and secondary windings, respectively, the present invention is not limited to this example. The winding 200 may be the secondary winding, and the winding 210 may be the primary winding. The excited energy of the air-core transformer depends on the number of turns and the diameter of a winding, so that the winding having a larger diameter, that is, the winding 200 is preferably used as the excitation winding, that is, the primary winding. The output winding for outputting a higher voltage needs to have a larger number of turns, and thus incurs a larger copper loss, so that the winding 210 having a smaller diameter is preferably used as the output winding. Requiring a higher voltage output from the output winding leads to a larger turn ratio between the windings 200 and 210 because the output voltage Vout depends on the input voltage Vin.

Figure 4:
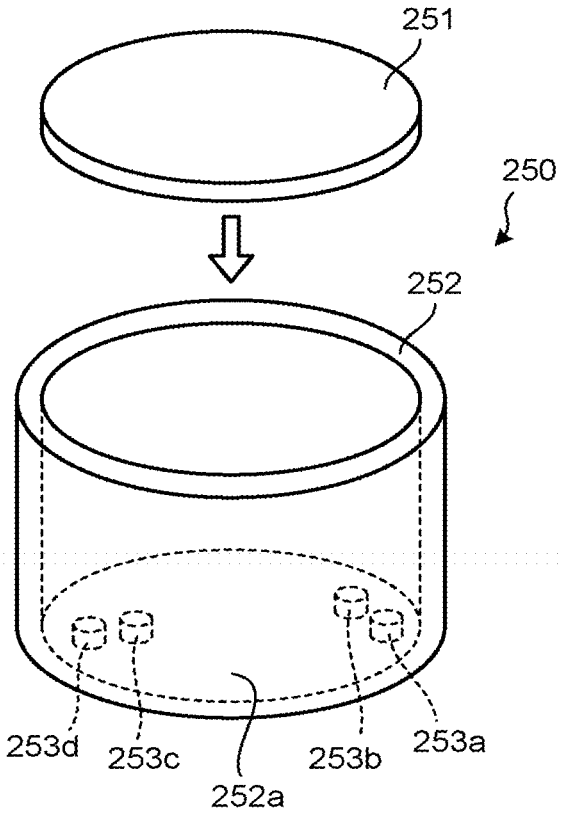
FIG. 4 is still another view for more specifically explaining the transformer according to the first embodiment.

FIG. 4 illustrates an example of an external view of a container 250 serving as a shell in which the combined windings 200 and 210 are contained. The container 250 illustrated in FIG. 4 is simplified for explanation of a function as a container, and is not limited to have the shape as illustrated. In FIG. 4, the container 250 includes a cover 251 and a cylindrical part 252 having a bottom plane 252*a*. The outer circumference of the cover 251 has the same radius as that of the inner circumference of the cylindrical part 252. The bottom plane 252*a* is provided with lead-out holes 253*a* to 253*d* for drawing out the lead wires 201*a*, 201*b*, 211*a*, and 211*b*.

A material having a low specific permittivity is preferably used for the container 250 (the cover 251 and the cylindrical part 252). The material of the container 250 only needs to be capable of maintaining sealability (to have substantially no gas permeability), and only needs to be an insulating material (a dielectric material). A resin or glass can be used as the material of the container 250. Glass is preferably used as the material of the container 250 when production cost is taken into account. The container 250 illustrated in FIG. 4 is configured to maintain the sealability after the cover 251 is fitted into the cylindrical part 252 and sealed, and the lead wires 201*a*, 201*b*, 211*b*, and 211*a* are passed through the lead-out holes 253*a* to 253*d* and sealed.

Figure 5:
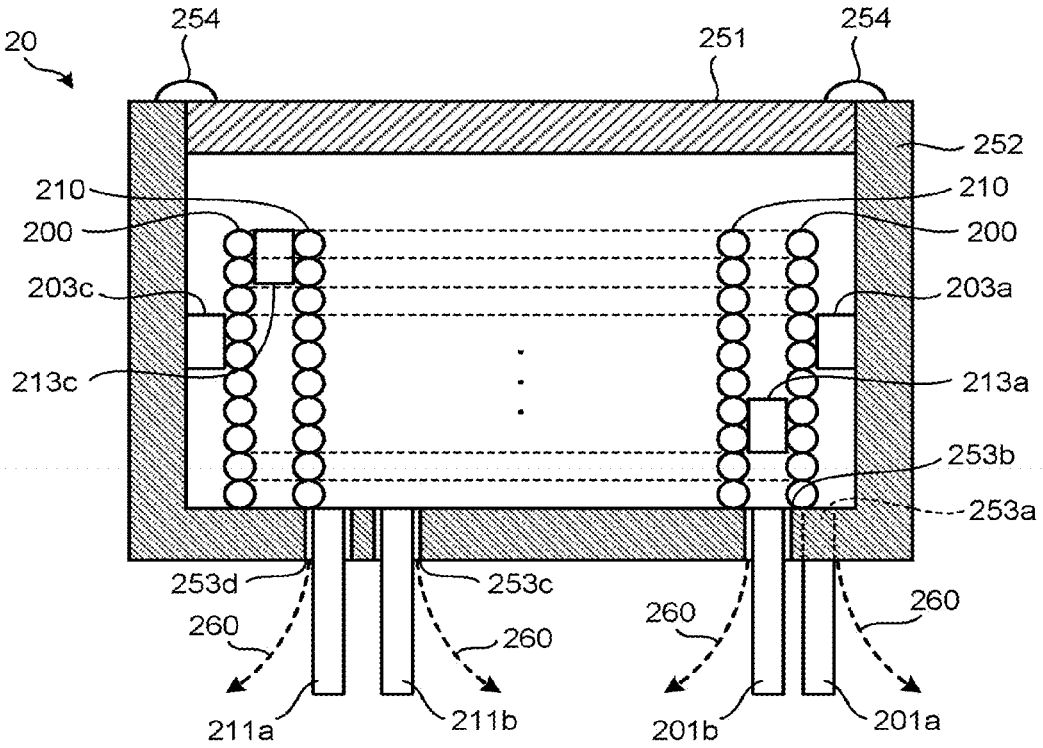
FIG. 5 is still another view for more specifically explaining the transformer according to the first embodiment.

FIG. 5 illustrates an example of a state in which the combined windings 200 and 210 are contained in the container 250, in the form of a diametral section of the container 250. In FIG. 5, portions common to those in FIGS. 2 and 4 explained above are given the same reference numerals as in FIGS. 2 and 4, and detailed description thereof will not be given.

In FIG. 5, the bridges 213*a*, 213*b*, and 213*c* maintain the appropriate spatial distance between the windings 210 and 200. Also, in the same manner, the bridges 203*a*, 203*b*, and 203*c* maintain the appropriate spatial distance between the winding 200 and the inner circumference of the container 250 (inner circumference of the cylindrical part 252). FIG. 5 does not illustrate the bridges 203*b* and 213*b*.

The boundary between the cover 251 and the cylindrical part 252 is sealed with a sealer 254. A material allowing no gas flow after hardening is selected as the sealer. The lead wires 201*a*, 201*b*, 211*b*, and 211*a* are drawn out from the lead-out holes 253*a* to 253*d*, respectively.

The water molecules are discharged from the interior of the container 250, for example, in this state. For example, an aging voltage Vage is applied to the lead wires 201*a* and 201*b* of the winding 200 and to the lead wires 211*a* and 211*b* of the winding 210 so as to age the windings 200 and 210. This aging causes the windings 200 and 210 to generate heat, so that a gas 260 including the water molecules in the container 250 is discharged from a gap between each of the lead-out holes 253*a* to 253*d* and corresponding one of the lead wires 201*a*, 201*b*, 211*b*, and 211*a*.

Figure 6:
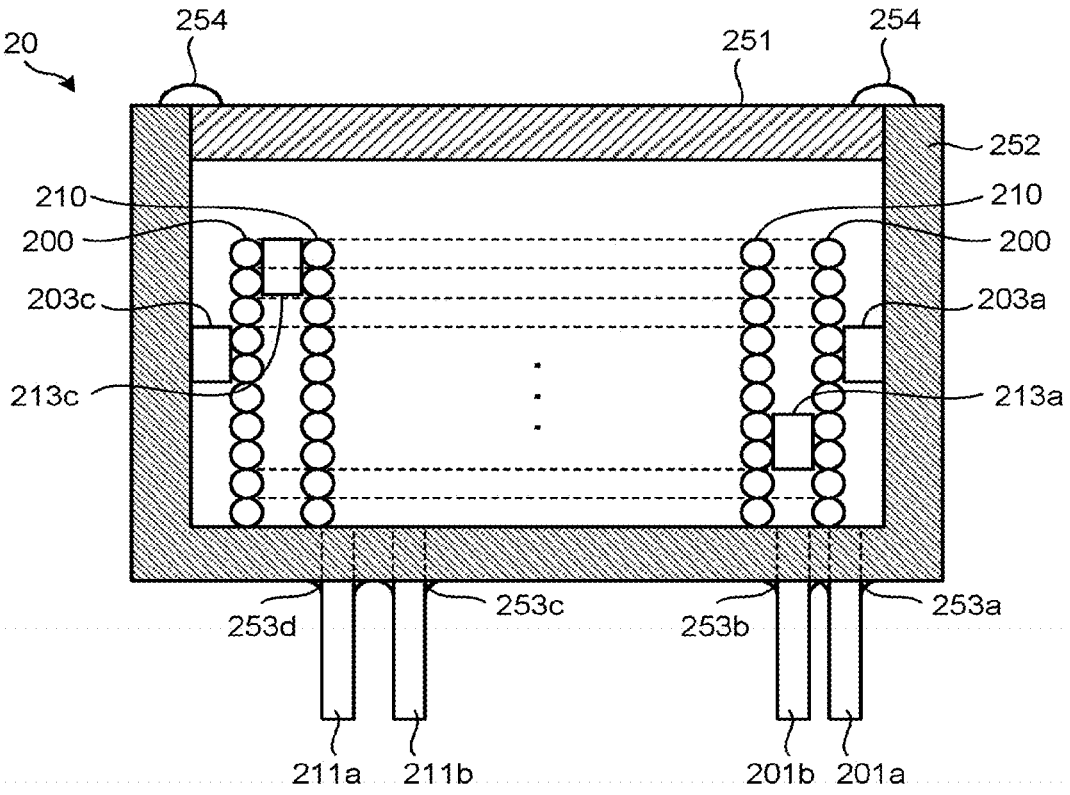
FIG. 6 is still another view for more specifically explaining the transformer according to the first embodiment.

In the state in which the aging has discharged the water molecules from the interior of the container 250, the gap between each of the lead-out holes 253*a* to 253*d* and corresponding one of the lead wires 201*a*, 201*b*, 211*b*, and 211*a* is sealed. This operation completes the final configuration of the transformer according to the first embodiment. FIG. 6 illustrates the configuration of the example of the transformer 20 in which the lead-out holes 253*a* to 253*d* are sealed with the sealer. In this manner, sealing the container 250 reduces a change in pressure in the container 250 associated with a change in the external environment, such as an external air pressure.

While the above description has exemplified that the transformer 20 includes the two windings, that is, the winding 200 serving as the excitation winding and the winding 210 serving as the output winding, the present invention is not limited to this example. For example, in addition to the excitation winding and the output winding, a winding, such as an auxiliary winding, for providing another function can be included in the transformer according to the first embodiment, in the same manner as described above.

As described above, the bridges 213*a* and 213*c* are provided in the positions not contained in the plane containing the bridges 203*a* and 203*c* that is orthogonal to the direction of the magnetic flux in the windings 200 and 210. In the first embodiment, the bridges 213*a* and 213*c* are provided in the positions shifted downward and upward, respectively, in the direction of the magnetic flux from the plane. This is because, for example, as will be described later, when the interior of the container 250 is depressurized to be in a vacuum state, voltages are applied among the bridges 203*a*, 203*c*, 213*a* and 213*c* if the bridges 203*a*, 203*c*, 213*a* and 213*c* having a higher specific permittivity than that of the vacuum state lie in the same plane orthogonal to the direction of the magnetic flux. Hence, as described above, the bridges 213*a* and 213*c* are provided so as not to be contained in the plane containing the bridges 203*a* and 203*c*, so that the voltages applied among the bridges 203*a*, 203*c*, 213*a* and 213*c* can be reduced.

The magnetic flux is interlinked with a plane in the radial direction of the windings 200 and 210 at an angle of (½)π radians. A high-frequency return current flowing in the direction of canceling the magnetic flux is highest at the central part in the direction of the magnetic flux of the windings 200 and 210. For this reason, in the first embodiment, the positions of the bridges 213*a* and 213*c* are shifted so that the bridges 203*a*, 203*c*, 213*a* and 213*c* are not contained in the same plane orthogonal to the direction of the magnetic flux. The amounts of shift of the bridges 213*a* and 213*c* can be set to angles of, for example, (¼)π radians and (−¼)π radians, respectively, from the center of the windings 200 and 210.

While, in the description above, the bridges 213*a* and 213*c* are shifted in the up-down direction of the magnetic flux, the present invention is not limited to this example. For example, the bridges 213*a* and 213*c* may be provided in positions rotated in the plane orthogonal to the direction of the magnetic flux by a certain angle about the center of the plane. This configuration prevents the bridges 213*a* and 213*c* from being aligned in the same straight line with the bridges 203*a* and 203*c*, so that the voltages applied among the bridges 203*a*, 203*c*, 213*a* and 213*c* can be reduced.

The bridges 203*a*, 203*b*, 203*c*, 213*a*, 213*b*, and 213*c* preferably have as small a contact area as possible with the windings 200 and 210.

First Modification of First Embodiment

The following describes a first modification of the first embodiment. According to the first modification of the first embodiment, in the transformer 20 described using FIGS. 2 to 6 in the first embodiment, the air pressure in the container 250 differs from the external air pressure. For example, the interior of the container 250 is depressurized by discharging air therefrom so as to set the air pressure in the container 250 lower than the external air pressure. The specific permittivity can preferably be further reduced by fixing the air pressure in the container 250 to, for example, a value in the range of 0.8 atmosphere (inclusive) to 1 atmosphere (exclusive). In addition, the water molecules in the container 250 can preferably be more effectively eliminated by placing the interior of the container 250 in a vacuum state at an air pressure of $10^{-1}$ pascal (Pa) or lower.

Figure 7:
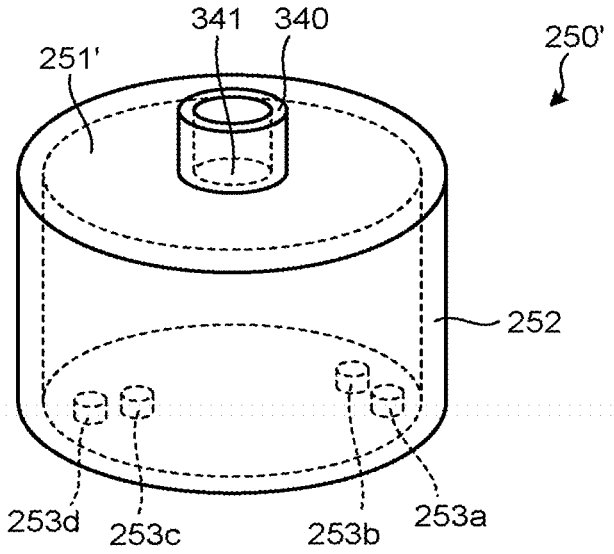
FIG. 7 is a view illustrating an example of an external view of a container with a depressurizable interior according to a first modification of the first embodiment.

FIG. 7 illustrates an example of an external view of a container with a depressurizable interior according to the first modification of the first embodiment. In FIG. 7, portions common to those in FIG. 4 explained above are given the same reference numerals as in FIG. 4, and detailed description thereof will not be given. In FIG. 7, a cover 251' of a container 250' is provided with an air discharge port 340 that has a through-portion 341 passing through the cover 251'. FIG. 7 illustrates a state in which the cover 251' is inserted in the cylindrical part 252.

Figure 8:
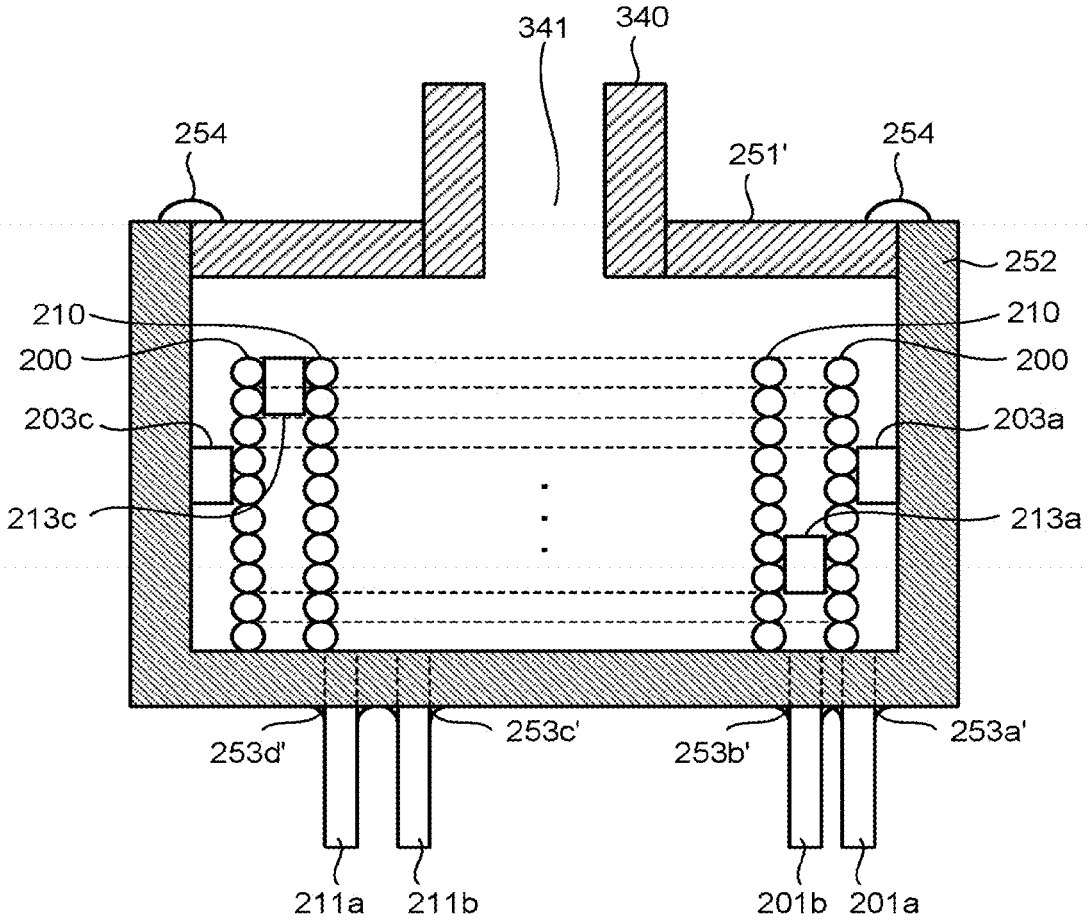
FIG. 8 is a view illustrating the container of FIG. 7 in the form of a diametral section of the container.

FIG. 8 illustrates the container 250' of FIG. 7 in the form of a diametral section of the container 250'. In FIG. 8, portions common to those in FIGS. 2 and 4 explained above are given the same reference numerals as in FIGS. 2 and 4, and detailed description thereof will not be given. The example of FIG. 8 illustrates a state in which the combined windings 200 and 210 are contained in the container 250'.

In the example of FIG. 8, lead-out holes 253*a*' to 253*d*' are sealed at a stage where the windings 200 and 210 are contained in the container 250'. When the aging as described above is applied to the windings 200 and 210 in this state, the water molecules in the container 250' are discharged from the air discharge port 340. Then, a vacuum pump, for example, is used to discharge air from the interior of the container 250' through the air discharge port 340. After the interior of the container 250' is depressurized to a predetermined pressure, the opening of the air discharge port 340 is sealed to fix the air pressure in the container 250' to an air pressure lower than the atmospheric pressure.

The opening of the air discharge port 340 can be sealed, for example, by making the discharge port 340 of glass, and discharging air from the interior of the container 250', and then by heating to fusion bond the air discharge port 340 to itself.

The structure for depressurizing the interior of the container is not limited to that of FIG. 7. For example, the container 250 illustrated in FIGS. 4 and 5 may be depressurized by discharging air from the lead-out holes 253*a* to 253*d*.

Second Modification of First Embodiment

In the description above, the windings 200 and 210 constitute the air-core transformer. In contrast, a second modification of the first embodiment is an example in which the air-core portion of the windings 200 and 210 is provided with a core, such as a ferrite core, that has a high maximum magnetic flux density.

Figure 9:
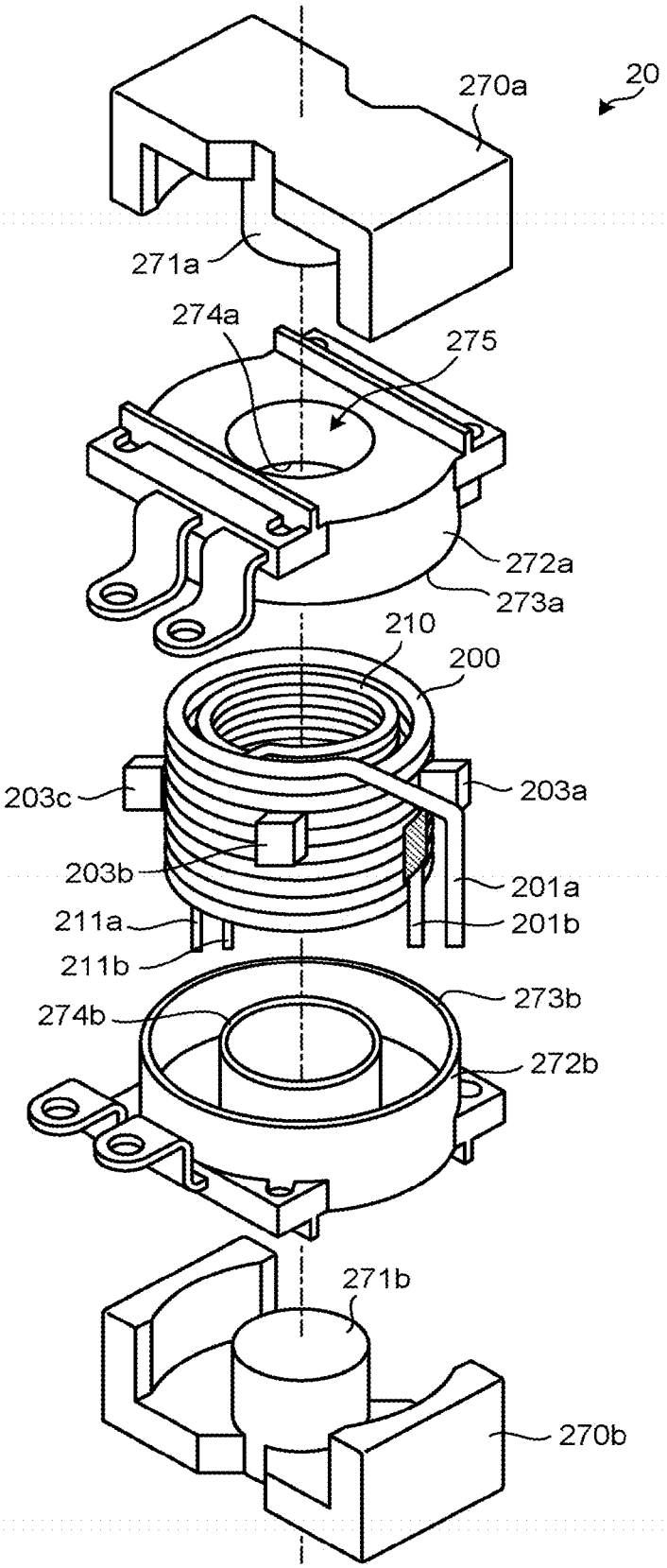
FIG. 9 is a view illustrating a configuration of an example of a transformer according to a second modification of the first embodiment.

FIG. 9 illustrates a configuration of an example of a transformer according to the second modification of the first embodiment. In FIG. 9, portions common to those in FIGS. 2 to 5 explained above are given the same reference numerals as in FIGS. 2 to 5, and detailed description thereof will not be given.

In FIG. 9, this transformer 20 according to the second modification of the first embodiment is configured as follows: the windings 200 and 210 are contained in a shell made by assembling an upper container 270*a* and a lower container 270*b* so as to interpose the windings 200 and 210 therebetween; and an inner leg (center) 271*a* of an upper core 270*a* and an inner leg 271*b* of a lower core 270*b* are inserted into a hole 275 common to the upper container 272*a* and the lower container 272*b*. Accordingly, bridges for maintaining a certain spatial distance are also provided in the inner circumference of the winding 210 embedded inside.

In this structure, the sealability of the interior of the upper and lower containers 272*a* and 272*b* can be maintained by bonding outer circumferential rims 273*a* and 273*b* of the upper and lower containers 272*a* and 272*b* to each other, and also bonding inner circumferential rims 274*a* and 274*b* thereof to each other.

Moreover, an opening can be provided, for example, in the side face or the top face of the upper container 272*a*, or in the side face or the bottom face of the lower container 272*b* so as to perform the aging and the air discharge to discharge the water molecules and depressurize the shell, through the opening, after the upper and lower containers 272*a* and 272*b* are bonded together.

Advantageous Effects

As disclosed in Japanese Patent Application Laid-open No. 2012-135112, in a transformer of an existing technology, insulation layers are provided between respective layers of windings, and each of the insulation layers is formed with several layers of a flame-retardant tape having a low specific permittivity and a low dielectric tangent. Moreover, to output a high voltage, the transformer needs to have an output winding of a large number of turns, so that one layer around a bobbin is not enough to form the output winding. As a result, the output winding needs to be divided. Dividing the output winding increases the area occupied by the insulation layers between the windings by the number of divisions, so that the distributed capacitance increases, and the number of turns increases as the output voltage is higher. As a result, the self-resonant frequency $f_0$ of the transformer decreases, and, from the viewpoint of the output, the frequency bandwidth of the output inductance Ls of the transformer decreases.

In contrast, in the transformer according to any of the first embodiment and the modifications thereof, an insulation layer between the layers is formed not by the conventional flame-retardant tape, but by ensuring the space between the windings 200 and 210. Accordingly, the insulation layer has a specific permittivity of approximately 1 and a dielectric tangent of substantially 0, and thus can achieve a higher self-resonant frequency $f_0$ than that of the conventional configuration in which the insulation layers are formed by the flame-retardant insulation tape.

Figure 10:
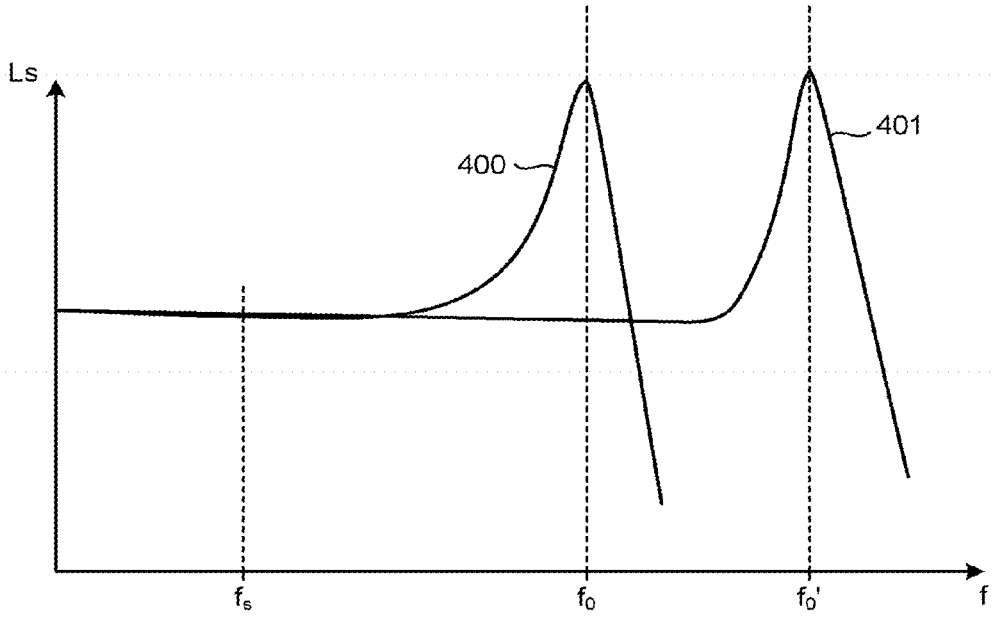
FIG. 10 is a diagram illustrating examples of a frequency characteristic of output inductance Ls of the transformer according to any of the first embodiment and the modifications thereof and that of a transformer according to an existing technology.

FIG. 10 illustrates examples of a frequency characteristic of the output inductance Ls of the transformer according to any of the first embodiment and the modifications thereof and that of the transformer according to the existing technology. In FIG. 10, a characteristic line 400 represents an example of the characteristic of the transformer according to the conventional technology that uses the flame-retardant insulation tape between the windings, and a characteristic line 401 represents an example of the characteristic of the transformer according to any of the first embodiment and the modifications thereof. The peaks of the respective characteristic lines 400 and 401 correspond to self-resonant frequencies $f_0$ and $f_0'$ of the respective transformers.

As illustrated in FIG. 10, the self-resonant frequency $f_0'$ of the transformer according to any of the first embodiment and the modifications thereof can be higher than the self-resonant frequency $f_0$ of the transformer according to the conventional technology. The switching frequency $f_s$ needs to be set in a region where the frequency characteristic of the output inductance Ls is flat. The maximum time ratio (on duty) usable in the output resonant state has a relation of $1-f_s/f_0$ to the switching frequency $f_s$. Due to this relation, increasing the self-resonant frequency $f_0$ reduces the time occupied by one cycle of the output resonance, and thus can increase the excitation time, so that the control range increases, which is advantageous.

The flame-retardant insulating tape used in the conventional technology absorbs some amount of water molecules, so that it is difficult to eliminate the possibility of leakage and electric discharge in the transformer caused by the water molecules. In contrast, any of the first embodiment and the modifications thereof minimizes the use of the flame-retardant insulating tape, and also seals the container 250 (or the container 250') after the water molecules are eliminated by heating of the windings 200 and 210. As a result, the leakage and the electric discharge in the transformer caused by the water molecules can be reduced.

Structure of Transformer According to Second Embodiment

The following describes a structure of a transformer according to a second embodiment of the present invention. The transformer according to the second embodiment is configured by using a printed wiring board having a multilayer structure (multilayer board), and by forming a whirling pattern whirling on each layer of the multilayer board. The whirling patterns formed on respective layers of one multilayer board are connected via via-holes, and form one winding as a whole of the multilayer board. In this formation, the whirling patterns on the respective layers of the multilayer board are formed so that patterns on adjacent first and second layers do not overlap in the stacking direction of the multilayer board.

In this manner, first and second multilayer boards with respective windings formed thereon are arranged in a row in the stacking direction of the multilayer boards. Then, for example, a ferrite core penetrates the centers of the whirling patterns of the respective multilayer boards, so that a winding by the whirling patterns formed in the first multilayer board and a winding by the whirling patterns formed in the second multilayer board serve as the first and the second windings, respectively, and constitute the transformer as a whole.

Figure 11:
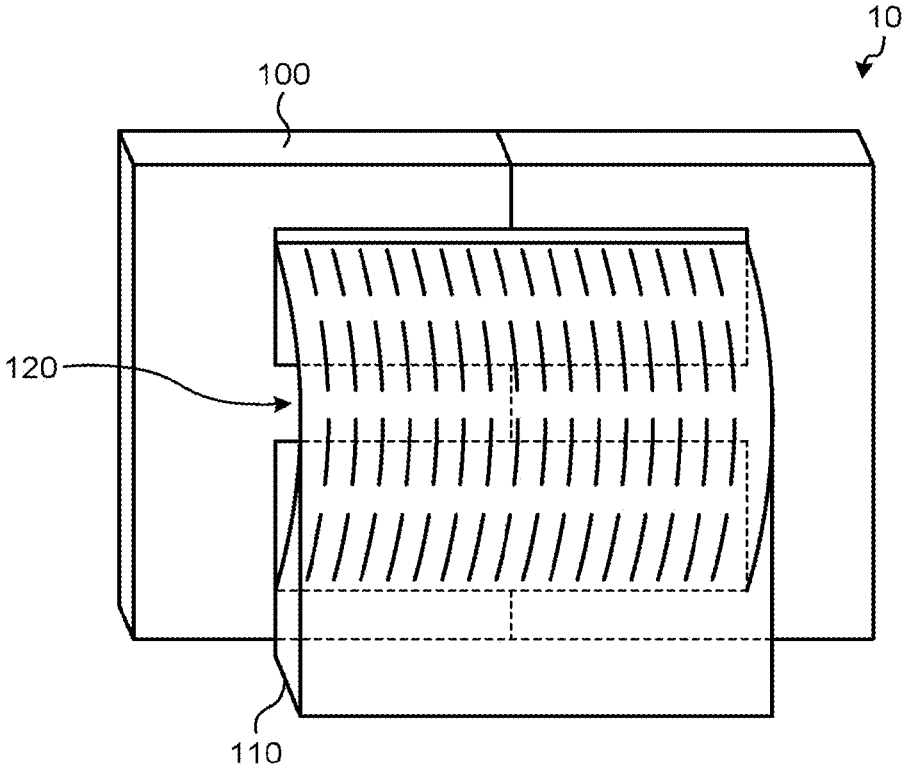
FIG. 11 is a view schematically illustrating a structure of a transformer according to a second embodiment of the present invention.

FIG. 11 schematically illustrates the structure of the transformer according to the second embodiment. In FIG. 11, this transformer 10 includes a core 100 and a winding unit 110 that includes a plurality of multilayer boards in which windings by the whirling patterns are formed. More specifically, the winding unit 110 includes the multilayer boards arranged in a row in the stacking direction of the multilayer boards, in each of which a winding is formed. An inner leg 120 of the core 100 penetrates a hole provided in inner circumferential portions of the whirling patterns through the respective layered boards in the winding unit 110.

Figure 12:
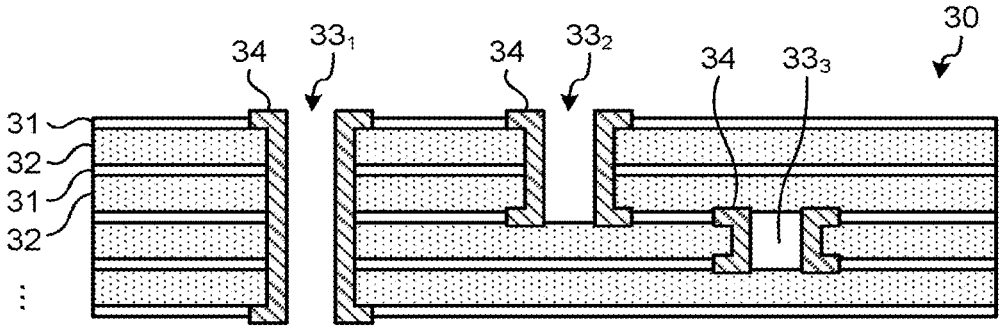
FIG. 12 is a view for schematically explaining a multilayer board.

The following schematically describes the multilayer board, using FIG. 12. In FIG. 12, this multilayer board 30 has a structure in which a plurality of layers including a patterned plane 31 made of a conductor and a substrate portion 32 made of an insulating material are stacked. Hereinafter, the patterned planes 31 on the top surface and the bottom surface are each called an outer layer pattern, and the other patterned planes 31 are each called an inner layer pattern, where appropriate.

The patterned planes 31 of the respective layers are electrically connected by via-holes $\mathbf{33}_1$, $\mathbf{33}_2$, and $\mathbf{33}_3$ penetrating predetermined layers in the stacking direction of the layers. Each of the via-holes $\mathbf{33}_1$, $\mathbf{33}_2$, and $\mathbf{33}_3$ connects the patterned planes 31 of the respective layers via a conducting part 34 provided by, for example, plating. In FIG. 12, the via-hole $\mathbf{33}_1$ represents a type that penetrates all layers of the multilayer board 30, and the via-holes $\mathbf{33}_2$ and $\mathbf{33}_3$ represent a type that connects only targeted layers of the multilayer board 30 together.

Figure 13A:
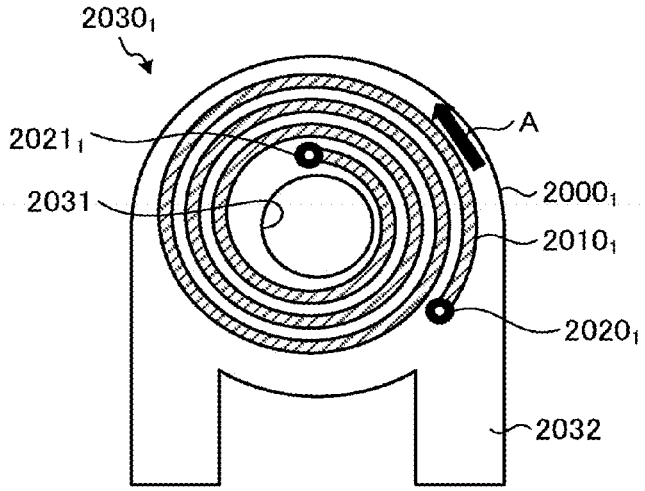
FIGS. 13A to 13C are diagrams for explaining the structure of the transformer according to the second embodiment.

The following describes the structure of the transformer according to the first embodiment, using FIGS. 13A to 16. FIGS. 13A to 13C illustrate examples of the whirling patterns formed on the patterned planes 31 of the multilayer board 30. FIGS. 13A, 13B, and 13C illustrate the examples of the whirling patterns formed on the patterned planes 31 of first to third sequentially adjacent layers $\mathbf{2000}_1$ to $\mathbf{2000}_3$, respectively, among the layers of the multilayer board 30.

A hole 2031 for passing the inner leg 120 of the core 100 therethrough is provided at a corresponding location of each of the first to third layers $\mathbf{2000}_1$ to $\mathbf{2000}_3$. The first to third layers $\mathbf{2000}_1$ to $\mathbf{2000}_3$ constitute winding units $\mathbf{2030}_1$, $\mathbf{2030}_2$, and $\mathbf{2030}_3$, respectively, each formed by a whirling pattern. In addition, each of the first to third layers $\mathbf{2000}_1$ to $\mathbf{2000}_3$ is provided with lead-out portions 2032 so as to be capable of leading out lead wires from corresponding one of the winding units 2030$_1$, 2030$_2$, and 2030$_3$.

In FIG. 13A, the first layer 2000$_1$ is provided with a whirling pattern 2010 that spirally whirls from a terminal 2020$_1$ (serving as a start point) on the outermost circumference toward a terminal 2021$_1$ (serving as an end point) on the innermost circumference. In other words, in the example of FIG. 13A, the whirling pattern 2010$_1$ whirls on the first layer 2000$_1$ counterclockwise as indicated by arrow A in FIG. 13A.

The whirling pattern 2010$_1$ is formed so that turns of the pattern are arranged at regular intervals in the radial direction thereof when viewed in a section taken in the radial direction. In this formation, each interval between the turns of the pattern is equal to or larger than the width of the pattern. In this manner, having a predetermined interval between the turns of the pattern reduces a proximity effect. The width of the pattern is preferably set so that the sectional area of the pattern is equal to that of a round wire required for a winding used in the transformer.

In FIG. 13A, the terminal 2020$_1$ is provided so as to be connected to a lead wire.

A spiral curve represented by $r=a+b\theta$ in a polar coordinate system can be used as the whirling pattern. The spiral curve constituting the whirling pattern is not limited to this example, but another curve may be used if the turns of the pattern are arranged at regular intervals in the radial direction thereof.

If the sectional area is insufficient because of a large number of turns on one layer, the whirling pattern 2010$_1$ can be divided or parallelized. Specifically, if the output voltage from the output winding is much higher than the input voltage to the excitation winding, that is, if the transformer has a high step-up ratio, the output winding has a large number of turns, resulting in an insufficient width of the pattern in some cases. In such cases, the number of turns is divided, or alternatively, the sectional area of the pattern is divided to 1/n, and the numbers of turns of n parallel output windings are superimposed. The same applies to the case of dividing the number of turns.

In order to reduce the distributed capacitance between the layers produced by the superimposition of the layers, a layer is preferably provided in which no pattern is formed except necessary patterns, such as a via-hole.

The parallel or divided windings are formed in a plurality of layers. In this case, in the second embodiment, the whirling patterns are formed so that the patterns on adjacent layers do not overlap each other when viewed from the stacking direction of the multilayer board 30. The following describes the whirling patterns that do not overlap between the adjacent layers, using FIGS. 13B, 13C, and 14.

Figure 13B:
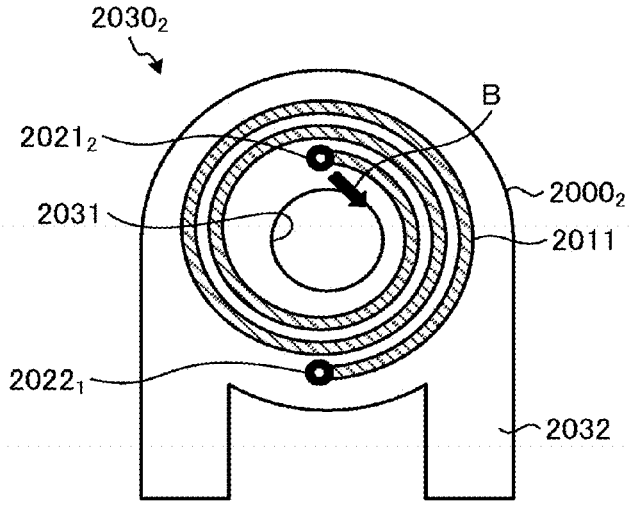

FIG. 13B illustrates the example of a whirling pattern 2011 formed on the second layer 2000$_2$ adjacent to the first layer 2000$_1$. In the whirling pattern 2011, a terminal 2021$_2$ on the innermost circumference thereof is connected via a via-hole to the terminal 2021$_1$ on the innermost circumference of the whirling pattern 2010$_1$ on the first layer 2000$_1$ described above. The whirling pattern 2011 is formed by spirally whirling from the terminal 2021$_2$ serving as a start point on the innermost circumference toward a terminal 2022$_1$ serving as an end point on the outermost circumference.

Figure 14:
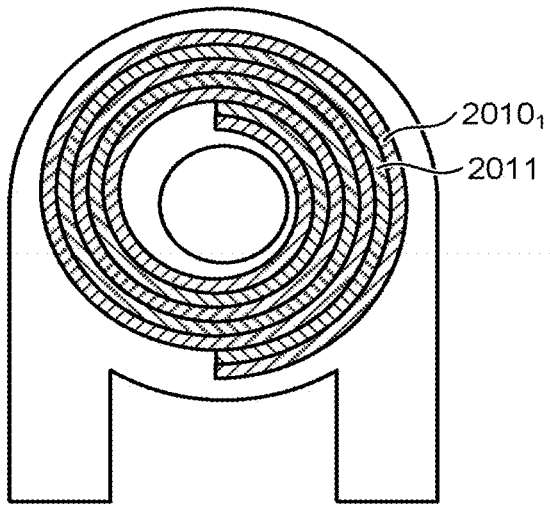
FIG. 14 illustrates another diagram for explaining the structure of the transformer according to the second embodiment.

As illustrated in FIG. 14, the whirling pattern 2011 is formed so as not to overlap the whirling pattern 2010$_1$ of the adjacent first layer 2000$_1$ when viewed from the integrating direction of the multilayer board 30.

Accordingly, as indicated by arrow B in FIG. 13B, the whirling pattern 2011 whirls clockwise, which is the reverse direction to that of the whirling pattern 2010$_1$ described above.

While the example of FIG. 14 illustrates that the whirling patterns 2010 and 2011 are formed without a gap therebetween, the present invention is not limited to this example. A gap may be provided between the whirling patterns 2010$_1$ and 2011.

Figure 13C:
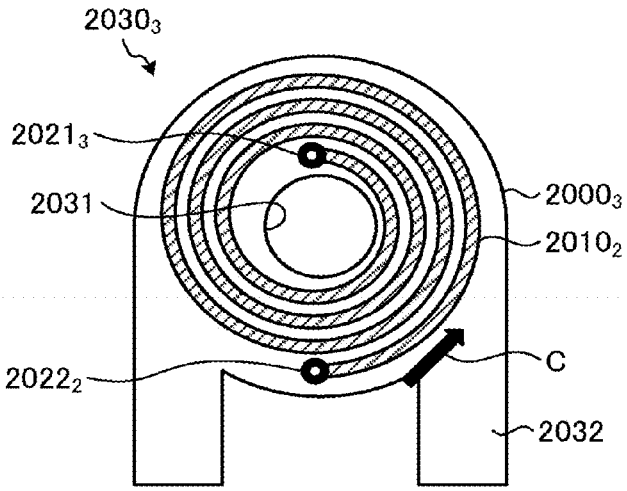

FIG. 13C illustrates the example of a whirling pattern 2010$_2$ formed on the third layer 2000$_3$ adjacent to the second layer 2000$_2$. In the whirling pattern 2010$_2$, a terminal 2022$_2$ on the outermost circumference thereof is connected via a via-hole to the terminal 2022$_1$ on the outermost circumference of the whirling pattern 2011 on the second layer 2000$_2$ described above. The whirling pattern 2010$_2$ is formed by spirally whirling from the terminal 2022$_2$ serving as a start point on the outermost circumference toward a terminal 2021$_3$ serving as an end point on the innermost circumference.

Also in this case, the whirling pattern 2010$_2$ is formed so as not to overlap the whirling pattern 2011 of the adjacent second layer 2000$_2$ when viewed from the integrating direction of the multilayer board 30. Accordingly, as indicated by arrow C in FIG. 13C, the whirling pattern 2010$_1$ whirls counterclockwise, which is the reverse direction to that of the whirling pattern 2011 described above.

Figure 15A:
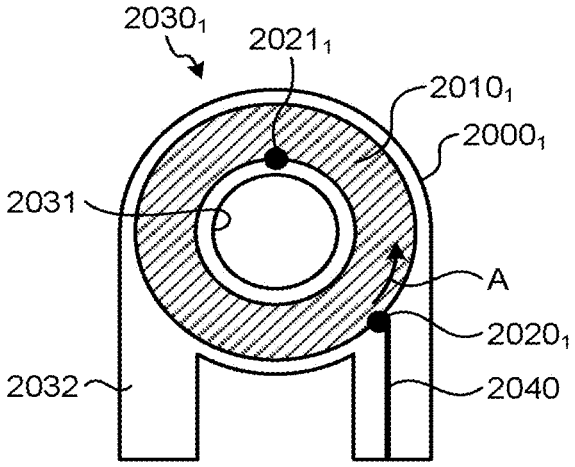
FIGS. 15A and 15B are still other diagrams for explaining the structure of the transformer according to the second embodiment.
Figure 15B:
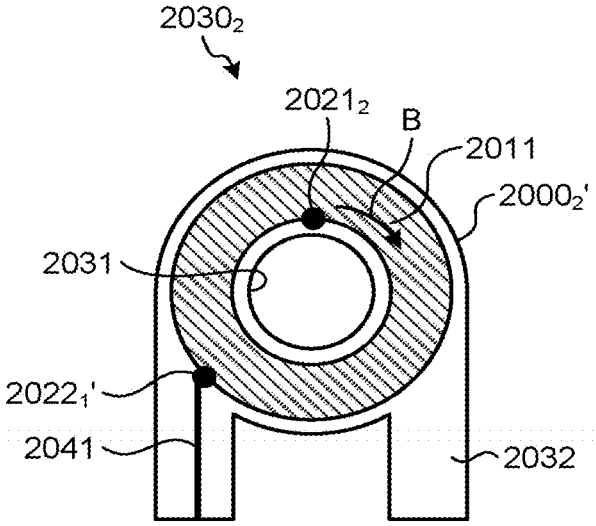

FIGS. 15A and 15B illustrate examples of layers of a winding start and a winding end of a winding including a plurality of whirling patterns connected via via-holes. In FIGS. 15A and 15B, for purposes of explanation, the winding includes the first and the second layers 2000$_1$ and 2000$_2$ illustrated in FIGS. 13A and 13B. In this case, the terminal 2020 of the start point of the whirling pattern 2010$_1$ on the first layer 2000$_1$ serves as the winding start, and a terminal 2022$_1$' on the outermost circumference of the whirling pattern 2011 on a second layer 2000$_2$' serves as the winding end.

This case assumes that the first layer 2000$_1$ illustrated in FIG. 15A is disposed on the front side of the second layer 2000$_2$' illustrated in FIG. 15B.

As illustrated in FIG. 15A, a lead wire 2040 is connected to the terminal 2020$_1$ at the winding start. A pattern is formed on a layer further on the front side of the first layer 2000$_1$, and is directly connected to the terminal 2020$_1$ for the lead wire 2040 by a via-hole at a location corresponding to that of the terminal 2020$_1$.

A lead wire 2041 is connected to the terminal 2022$_1$' at the winding end. Conversely to the case of the first layer 2000$_1$, a pattern is formed on a layer further on the back side of the second layer 2000$_2$', and is directly connected to the terminal 2022$_1$' for the lead wire 2041 by a via-hole at a location corresponding to that of the terminal 2022$_1$'.

In this manner, the lead wires at the winding start and the winding end are led out toward directions opposite to each other with respect to each of the layers.

Figure 16:
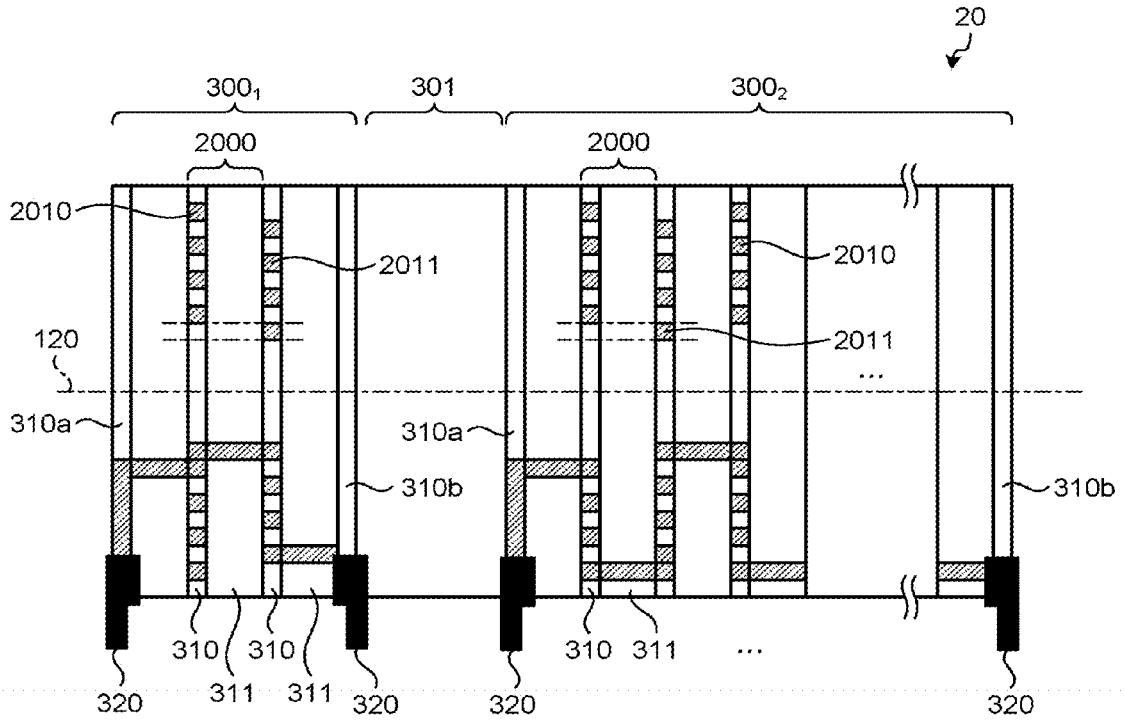
FIG. 16 illustrates still another diagram for explaining the structure of the transformer according to the second embodiment.

FIG. 16 illustrates the entire transformer 20 according to the second embodiment including the windings by the whirling patterns formed in the multilayer board, in the form of a section of the multilayer board. FIG. 16 indicates conductive portions, such as the patterns and the via-holes, with hatchings.

In an example of FIG. 16, the transformer 20 according to the second embodiment includes two windings provided by multilayer boards 300$_1$ and 300$_2$ (each corresponding to the multilayer board 30 of FIG. 12). Each of the multilayer boards 300$_1$ and 300$_2$ includes a plurality of layers 2000 each including a patterned plane 310 and a substrate portion 311 (corresponding to the patterned plane 31 and the substrate portion 32, respectively, in FIG. 12). The multilayer boards $\mathbf{300}_1$ and $\mathbf{300}_2$ are arranged in a row in the stacking direction of the layers 2000 with centers of the holes 2031 illustrated in, for example, FIGS. 13A to 13C aligned with one another. A region 301 between the multilayer boards $\mathbf{300}_1$ and $\mathbf{300}_2$ may be a space, or, for example, a multilayer board free of all patterned planes, or another insulating material.

In the layers 2000 serving as inner layer patterns of the multilayer boards $\mathbf{300}_1$ and $\mathbf{300}_2$, the whirling pattern 2010 whirling counterclockwise and the whirling pattern 2011 whirling clockwise are alternately arranged. In this arrangement, the whirling patterns 2010 and 2011 on an adjacent pair of the layers 2000 are formed so as not to overlap each other in the stacking direction of the layers 2000. The start point of one of the whirling patterns 2010 and 2011 is sequentially connected to the end point of the other thereof by a via-hole so as to constitute one winding, as illustrated, for example, in the multilayer board $\mathbf{300}_2$.

Patterned planes 310*a* and 310*b* serving as outer layer patterns on each of the multilayer boards $\mathbf{300}_1$ and $\mathbf{300}_2$ are provided with lead-out pins 320, 320, . . . , each of which is connected to corresponding one of the lead wires 2040 and 2041. The patterned planes 310*a* and 310*b* serving as the outer layer patterns are not provided with whirling patterns.

Referring to FIG. 1, the configuration described above can provide the transformer 20 as a whole by using, for example, the multilayer boards $\mathbf{300}_1$ and $\mathbf{300}_2$ as the windings 200 and 210, respectively. The transformer 21 is provided in the same manner. Then, the transformers 20 and 21 are arranged side by side with the centers of the holes 2031 aligned with one another, and the inner leg 120 of the core 100 is passed through the holes 2031 of the transformers 20 and 21. With this configuration, the transformers 20 and 21 share the magnetic flux, and thus can constitute the transformer 10 illustrated in FIG. 1.

In the configuration of FIG. 16, the layers 2000 with the whirling patterns 2010 and 2011 formed thereon are the inner layer patterns in the multilayer board, so that the whirling patterns 2010 and 2011 formed on the layers 2000 have a structure sealed from external air. Specifically, for example, in the multilayer board $\mathbf{300}_1$, the whirling patterns 2010 and 2011 have a structure sealed in a shell including the outer circumferences of the whirling patterns 2010 and 2011 and the patterned planes 310*a* and 310*b* serving as the outer layer patterns.

A case can occur in which an interlayer gap is produced between portions where the whirling patterns 2010 and 2011 are formed on the layers 2000 of the multilayer boards $\mathbf{300}_1$ and $\mathbf{300}_2$. In this case, the whirling patterns 2010 and 2011 can be sealed from external air using a method, such as filling the gap with, for example, a resin, or leaving circular patterns on the outer circumferences of the whirling patterns 2010 and 2011.

The present invention is not limited to this. For example, the entire transformer 20 including the multilayer boards $\mathbf{300}_1$ and $\mathbf{300}_2$ may be housed in a sealable container as described using FIGS. 4 to 9 in the first embodiment and the modifications thereof.

Advantageous Effects

In this manner, the second embodiment forms the winding so that the patterns on the adjacent layers do not overlap each other. As a result, on the assumption of equality between the interlayer distance and the pattern width, the interlayer capacitance is reduced from that in the case of overlapping patterns by a ratio of at least $1/(\sqrt{2})=0.707$ because the electrostatic capacitance C is proportional to the reciprocal of the inter-electrode distance.

The ratio of reduction in the electrostatic capacitance C increases with the interlayer distance. The patterns are not in a close contact with each other, resulting in a reduction in a loss caused by interference between an electric field and a magnetic field due to an effect of surface current flow (skin effect) produced by the proximity effect. This loss is an adverse effect factor that increases as the frequency increases and as the voltage increases, but can be reduced by the configuration of the second embodiment. This is specifically due to interference of a magnetic flux between the patterns because the magnetic field is generated according to the right-handed screw rule at an angle of $(1/2)\pi$ radians so as to block currents flowing in the patterns. This phenomenon is more marked as the voltage is higher.

In this manner, the configuration according the second embodiment provides the pattern structure that reduces the generation of the electrostatic capacitance between the adjacent layers of the patterns.

As described above, for example, the whirling pattern $\mathbf{2010}_1$ of the first layer $\mathbf{2000}_1$ is directly connected to the whirling pattern 2011 of the second layer $\mathbf{2000}_2$ via via-holes by the terminals $\mathbf{2021}_1$ and $\mathbf{2021}_2$ provided at locations corresponding to each other. In other words, in the connection between the whirling patterns $\mathbf{2010}_1$ and 2011, no patterns are used that intersect each other. This configuration can reduce the distributed capacitance between the layers.

Moreover, the whirling patterns of the adjacent layers are directly connected together by the via-holes, and thus can be connected at the shortest distance. This configuration can greatly reduce linkage inductance of the output winding, and thus can provide a more ideal state with a better magnetic coupling. This can reduce a surge voltage applied to a switching element in the logical state of off generated by a back electromotive force caused by the inductance, so that a margin in the allowable tolerable voltage of the switching element is increased, and thus, a more reliable transformer can be provided.

The whirling patterns are formed on the inner layer patterns of the multilayer board, and are not formed on the outer layer patterns. Hence, the whirling patterns are hardly affected by the water molecules, so that the generation of leakage is reduced. Due to these advantageous effects, employing the configuration according to the second embodiment can provide a more reliable transformer.

Modification of Second Embodiment

Figure 17:
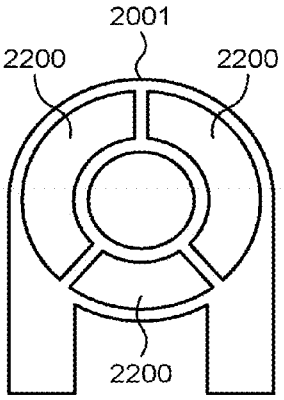
FIG. 17 is a diagram illustrating an example of a board according to a modification of the second embodiment.

The following describes a modification of the second embodiment. FIG. 17 is illustrates an example of a board 2001 according to the modification of the second embodiment. The board 2001 has the same size as that of the layers 2000 and the like described above, and has regions 2200, 2200, . . . that are spaces. Shapes and number of the regions 2200 are not limited to those in the example of FIG. 17.

The board 2001 is provided in a layer without a whirling pattern in the multilayer board having the whirling patterns formed on respective layers. For example, taking the example of FIG. 16, the configuration of the board 2001 can be used instead of that of one of the layers 2000 provided with via-holes in the center of the multilayer board $\mathbf{300}_1$. In this case, the regions 2200 as spaces are provided at locations other than those of the via-holes. Alternatively, the board 2001 may be inserted, for example, in the region 301 serving as a space illustrated in FIG. 16.

The distributed capacitance between the layers can be further reduced by including the board 2001 provided with the regions 2200 as spaces in the configuration of the transformer 10, as described above. A glass epoxy is often used as a material of the multilayer board, and has a relatively large specific permittivity of 3 to 5. In this case, the capacitance can be reduced by including the board 2001 provided with the regions 2200 as spaces in the configuration of the transformer 10.

The second embodiment and the modification thereof also do not need to use the conventional flame-retardant tape for the insulation between, for example, the windings 200 and 210 (between the multilayer boards $\mathbf{300}_1$ and $\mathbf{300}_2$). Hence, in the same manner as in the case of any of the first embodiment and the modifications thereof, the self-resonant frequency $f_0'$ of a transformer according to either of the second embodiment and the modification thereof can be higher than the self-resonant frequency $f_0$ of the transformer according to the conventional technology (refer to FIG. 8). Accordingly, the second embodiment and the modification thereof can also provide the same effects as those of the first embodiment and the modifications thereof.

In the second embodiment and the modification thereof, the winding includes the whirling patterns formed on the respective inner layers of the multilayer board, so that the flame-retardant tape for the insulation between the layers of the windings does not need to be used, unlike in the transformer according to the conventional technology. Accordingly, the transformer according to either of the second embodiment and the modification thereof is hardly affected by the water molecules. As a result, the leakage and the electric discharge in the transformer caused by the water molecules can be reduced.

Third Embodiment

The following describes a third embodiment of the present invention. In an image forming system that performs printing by forming an image on a sheet (recording medium or printing medium) serving as a treatment target, a plasma treatment is performed as a pretreatment before the printing process. The third embodiment is an example in which the plasma generator for the plasma treatment employs the transformer 10 including the transformer 20 according to any of the first embodiment, the modifications of the first embodiment, the second embodiment, and the modification of the second embodiment, which have been described above.

First, the plasma treatment will be described. In order to prevent pigments of ink from dispersing and to aggregate the pigments immediately after the ink lands on the treatment target (also called the recording medium or the printing medium), the surface of the treatment target is acidified. The plasma treatment is used as a way of the acidification.

The plasma treatment as acidification treatment means (process) irradiates the treatment target with the plasma in the air atmosphere so as to cause polymers on the surface of the processing target to react to generate hydrophilic functional groups. Specifically, electrons e emitted from the discharge electrode are accelerated in an electric field, and excite and ionize atoms and molecules in the air atmosphere. The ionized atoms and molecules also emit electrons so as to increase high-energy electrons, so that a streamer discharge (plasma) occurs. The high-energy electrons produced by the streamer discharge break polymer bonds on the surface of the treatment target (such as coated paper) (a coating layer of the coated paper is solidified with calcium carbonate and starch serving as a binder, and the starch has a polymeric structure), and the broken polymer chains recombine with oxygen radicals O*, hydroxyl radicals ($OH^-$), and ozone $O_3$ in the gas phase. These processes are called the plasma treatment. The plasma treatment generates polar functional groups, such as hydroxyl groups and carboxyl groups, on the surface of the treatment target. As a result, hydrophilicity and acidity are given to the surface of the printing medium. The increase in the carboxyl groups acidifies (reduces the pH value of) the surface of the printing medium.

The following has been found. In order to prevent color mixture between dots caused by wet-spreading and coalescence of adjacent dots on the treatment target due to the increase in the hydrophilicity, it is important to aggregate colorants (such as pigments or dyes) in the dots, or to dry vehicles or let the vehicles permeate the treatment target earlier than the wet-spreading of the vehicles. Hence, in the present embodiment, the acidification treatment as the pretreatment for an inkjet recording process is performed to acidify the surface of the treatment target.

The term "acidification" used herein means reducing the pH value of the surface of the printing medium to a pH value at which the pigments contained in the ink are aggregated. To reduce the pH value means to increase the density of hydrogen ions $H^+$ in an object. The pigments contained in the ink are negatively charged before coming into contact with the surface of the treatment target, and disperse in the vehicles. The ink increases in viscosity with decrease in the pH value thereof. This is because more pigments that have been negatively charged in the vehicles of the ink are electrically neutralized as the acidity of the ink increases, and consequently, the pigments are aggregated together. Accordingly, the viscosity of the ink can be increased by reducing the pH value of the surface of the printing medium so as to reach a value corresponding to a required viscosity value of the ink. This is because the pigments are aggregated together as a result of the electrical neutralization thereof by the hydrogen ions $H^+$ on the surface of the printing medium when the ink adheres to the acid surface of the printing medium. This viscosity increase can prevent color mixture between adjacent dots, and prevent the pigments from permeating to the deep inside (or even to the back surface) of the printing medium. It should be noted that, to reduce the pH value of the ink to the pH value corresponding to the required viscosity, the pH value of the surface of the printing medium needs to be set lower than the pH value of the ink corresponding to required viscosity.

The pH value to obtain the required viscosity of the ink varies with properties of the ink. Specifically, some types of ink are increased in viscosity by the aggregation of the pigments at a relatively near-neutral pH value, but other types of ink need to have a lower pH value than that of the aforementioned types of ink to aggregate the pigments.

The behavior of aggregation of the colorants in dots, the drying rate of the vehicles, and the permeation rate thereof into the treatment target vary depending on, for example, the droplet size varying with the dot size (small droplets, medium droplets, or large droplets) and the type of the treatment target. Hence, in the present embodiment, the amount of plasma energy in the plasma treatment may be controlled to an optimal value according to, for example, the type of the treatment target and/or the print mode (droplet size).

Figure 18:
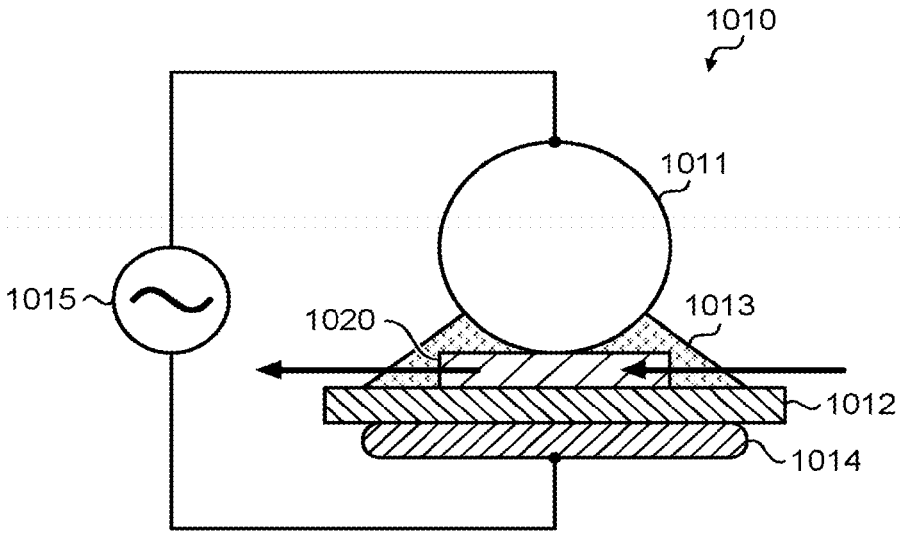
FIG. 18 is a schematic diagram for explaining an outline of an acidification treatment employed in a third embodiment of the present invention.

FIG. 18 is a schematic diagram for explaining the outline of the acidification treatment employed in the third embodiment. As illustrated in FIG. 18, the acidification treatment employed in the third embodiment uses a plasma treatment apparatus 1010 that includes a discharge electrode 1011, a counter electrode 1014, a dielectric material 1012, and a high-frequency high-voltage power supply 1015. In the plasma treatment apparatus 1010, the dielectric material 1012 is interposed between the discharge electrode 1011 and the counter electrode 1014. Each of the discharge electrode 1011 and the counter electrode 1014 may be an electrode with a metal portion thereof exposed, or an electrode coated with a dielectric material or an insulating material made of, for example, insulating rubber or ceramic. The dielectric material 1012 interposed between the discharge electrode 1011 and the counter electrode 1014 may be an insulating material made of, for example, polyimide, silicon, or ceramic. When a corona discharge is employed as the plasma treatment, the dielectric material 1012 may be omitted. However, the dielectric material 1012 is preferably provided in some cases, such as when a dielectric barrier discharge is employed. In that case, to obtain a larger creeping discharge area, the dielectric material 1012 is preferably located close to or in contact with the counter electrode 1014 rather than close to or in contact with the discharge electrode 1011. The larger creeping discharge area can increase the effect of the plasma treatment. The discharge electrode 1011 and the counter electrode 1014 (or the dielectric material 1012 instead of the electrode on which the dielectric material 1012 is provided) may be located at locations in contact with a treatment target 1020 passing between the two electrodes, or may be located at locations not in contact with the treatment target 1020.

The high-frequency high-voltage power supply 1015 applies a high-frequency high-voltage pulse voltage between the discharge electrode 1011 and the counter electrode 1014. The value of the pulse voltage is, for example, approximately or exactly 10 kV peak-to-peak. The frequency of the pulse voltage can be set to, for example, approximately or exactly 20 kHz. Supplying the high-frequency high-voltage pulse voltage between the two electrodes generates an atmospheric pressure non-equilibrium plasma 1013 between the discharge electrode 1011 and the dielectric material 1012. The treatment target 1020 passes between the discharge electrode 1011 and the dielectric material 1012 while the atmospheric pressure non-equilibrium plasma 1013 is being generated. This operation apples the plasma treatment to a surface of the treatment target 1020 facing the discharge electrode 1011.

The plasma treatment apparatus 1010 illustrated in FIG. 18 employs the rotary discharge electrode 1011 and the belt-conveyor type dielectric material 1012. The treatment target 1020 is conveyed while being held between the rotating discharge electrode 1011 and the dielectric material 1012 so as to pass through the atmospheric pressure non-equilibrium plasma 1013. This operation causes the surface of the treatment target 1020 to contact the atmospheric pressure non-equilibrium plasma 1013, and thus to be subjected to the uniform plasma treatment. The plasma treatment apparatus employed in the present embodiment is not limited to have the configuration illustrated in FIG. 18. The plasma treatment apparatus can have various modified configurations, such as a configuration in which the discharge electrode 1011 is close to, but not in contact with, the treatment target 1020 and a configuration in which the discharge electrode 1011 is mounted on the same carriage as that of an inkjet head. The plasma treatment apparatus is not limited to employ the belt-conveyor type dielectric material 1012, but may employ the flat-plate dielectric material 1012.

Figure 19:
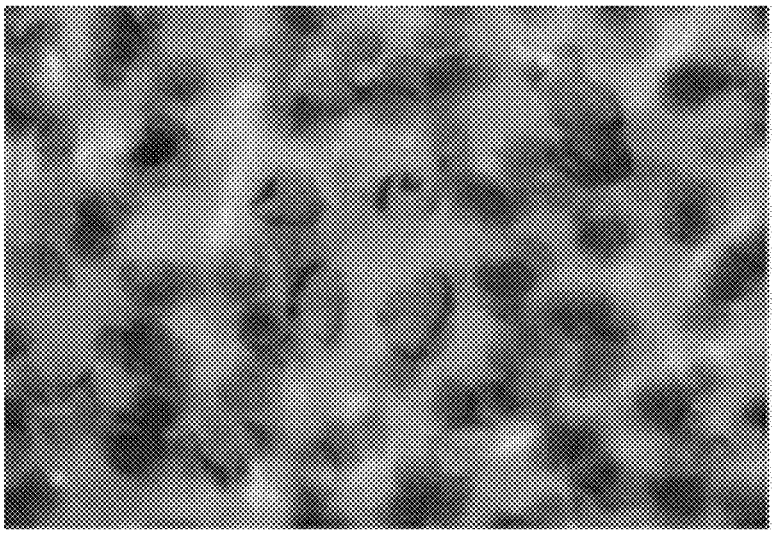
FIG. 19 is an enlarged view of an image obtained by capturing an image forming surface of a printed product obtained by applying an inkjet recording process to a treatment target that has not been subjected to a plasma treatment according to the third embodiment.
Figure 20:
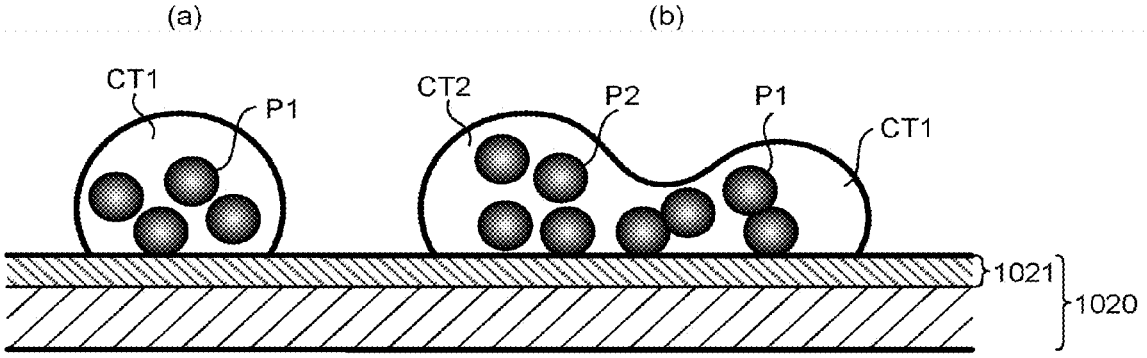
FIG. 20 is a schematic diagram illustrating an example of dots formed on the image forming surface of the printed product illustrated in FIG. 19.
Figure 21:
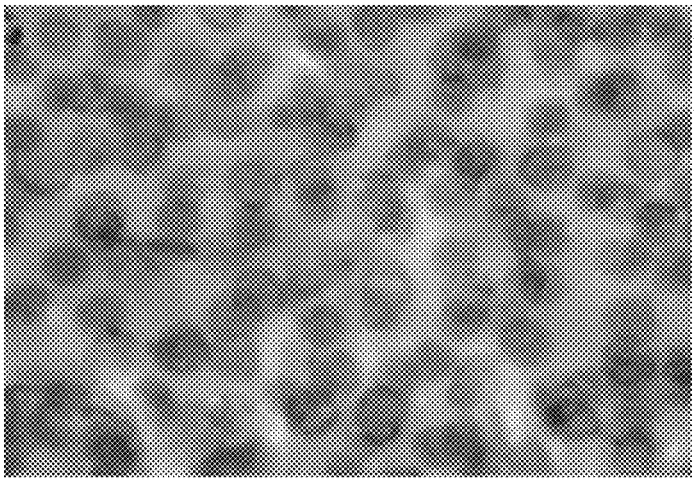
FIG. 21 is an enlarged view of an image obtained by capturing the image forming surface of another printed product obtained by applying the inkjet recording process to the treatment target that has been subjected to the plasma treatment according to the third embodiment.
Figure 22:
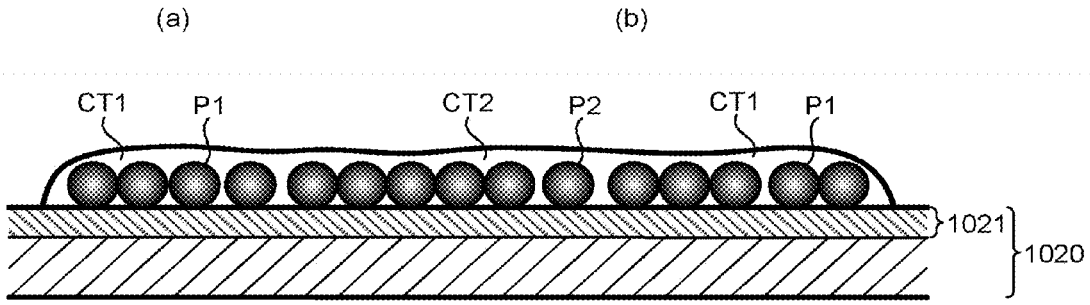
FIG. 22 is a schematic diagram illustrating an example of the dots formed on the image forming surface of the printed product illustrated in FIG. 21.

The following describes a difference in a printed product between a case of applying the plasma treatment according to the third embodiment and a case of not applying the plasma treatment, using FIGS. 19 to 22. FIG. 19 is an enlarged view of an image obtained by capturing an image forming surface of the printed product obtained by applying the inkjet recording process to the treatment target that has not been subjected to the plasma treatment according to the third embodiment. FIG. 20 is a schematic diagram illustrating an example of dots formed on the image forming surface of the printed product illustrated in FIG. 19. FIG. 21 is an enlarged view of an image obtained by capturing the image forming surface of another printed product obtained by applying the inkjet recording process to the treatment target that has been subjected to the plasma treatment according to the present embodiment. FIG. 22 is a schematic diagram illustrating an example of the dots formed on the image forming surface of the printed product illustrated in FIG. 21. A desktop inkjet recording apparatus was used to obtain the printed products illustrated in FIGS. 19 and 21. General coated paper having a coating layer was used as the treatment target 1020.

A coating layer 1021 on the surface of the coated paper has low wettability when the coated paper has not been subjected to the plasma treatment according to the third embodiment. As a result, in the image formed by applying the inkjet recording process to the coated paper not subjected to the plasma treatment, the shape of a dot (the shape of a vehicle CT1) attached to the surface of the coated paper when the dot has landed thereon is distorted, for example, as illustrated in FIGS. 19 and 20(*a*). If an adjacent dot is formed while the already landed dot is not sufficiently dried, vehicles CT1 and CT2 coalesce with each other when the adjacent dot lands on the coated paper, so that pigments P1 and P2 move (colors are mixed) between the dots, and, as a result, uneven density may occur due to, for example, beading, as illustrated in FIGS. 19 and 20(*b*).

In contrast, the coating layer 1021 on the surface of the coated paper that has been subjected to the plasma treatment according to the third embodiment has improved wettability. As a result, in the image formed by applying the inkjet recording process to the coated paper subjected to the plasma treatment, the vehicle CT1 spreads in a relatively flat perfect circular shape on the surface of the coated paper, for example, as illustrated in FIG. 21. This forms the dot in a flat shape as illustrated at (a) in FIG. 22. In addition, the polar functional groups generated by the plasma treatment acidify the surface of the coated paper. Hence, the ink pigments are electrically neutralized, so that the pigments P1 are aggregated to increase the viscosity of the ink. This restrains the movements (color mixture) of the pigments P1 and P2 between the dots even if the vehicles CT1 and CT2 coalesce with each other as illustrated at (b) in FIG. 22. Furthermore, the polar functional groups are also generated in the coating layer 1021, so that the permeability of the vehicle CT1 increases. This allows the ink to dry in a relatively short time. The dots that have each spread in the perfect circular shape due to the improved wettability are aggregated while permeating the treatment target, so that the pigments P1 are aggregated uniformly in the height direction, and hence, the uneven density can be restrained from being caused by, for example, the beading. FIGS. 20 and 22 are merely schematic diagrams. In the case illustrated in FIG. 22, the pigments are actually aggregated in layers.

As described above, in the treatment target 1020 subjected to the plasma treatment according to the third embodiment, the plasma treatment generates the hydrophilic functional groups on the surface of the treatment target 1020, and thereby improves the wettability. The plasma treatment also generates the polar functional groups so as to acidify the surface of the treatment target 1020. As a result of these improvements, the landed ink uniformly spreads on the surface of the treatment target 1020, and the negatively charged pigments are neutralized on the surface of the treatment target 1020 so as to be aggregated to increase the viscosity of the ink. Thus, the movements of the pigments can be restrained even if the spread of the ink results in the coalescence of the dots. The polar functional groups are also generated in the coating layer 1021 formed on the surface of the treatment target 1020, so that the vehicles quickly permeate the inside of the treatment target 1020, and thereby, drying time can be reduced. In other words, the increased wettability spreads each of the dots in the perfect circular shape, and the dots permeate the treatment target 1020 while the pigments are restrained from moving by being aggregated, so that each of the dots can maintain the nearly perfect circular shape.

Figure 23:
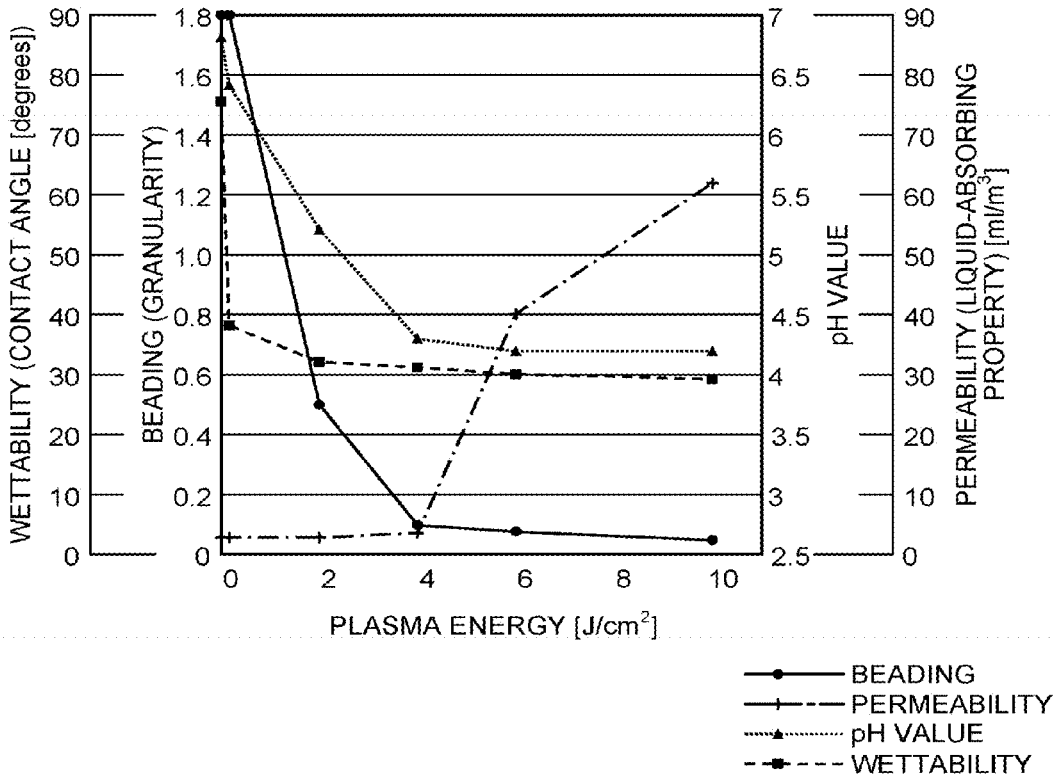
FIG. 23 is a graph illustrating relations of an amount of plasma energy with wettability, beading, a pH value, and permeability of a treatment target surface according to the third embodiment.

FIG. 23 is a graph illustrating relations of the amount of plasma energy with the wettability, the beading, the pH value, and the permeability of the treatment target surface according to the third embodiment. FIG. 23 uses the contact angle of the treatment target surface with respect to water to represent the wettability, the granularity to represent the beading, and the liquid-absorbing property to represent the permeability. FIG. 23 illustrates how surface properties (wettability, beading, pH Value, and permeability [liquid-absorbing property]) change depending on the amount of plasma energy when the printing is performed on the coated paper serving as the treatment target 1020. The ink used to obtain the evaluation illustrated in FIG. 23 was aqueous pigment ink (alkaline ink in which negatively charged pigments are dispersed) having a property of aggregating pigments with acid.

As illustrated in FIG. 23, the wettability of the surface of the coated paper is rapidly improved as the amount of plasma energy increases within a low value (such as approximately 0.2 J/cm$^2$ or lower), and is hardly improved as the energy increases beyond that value. The pH value of the surface of the coated paper is reduced to a certain extent by increasing the amount of plasma energy. The pH value, however, levels off at a point where the amount of plasma energy exceeds a certain value (such as approximately 4 J/cm$^2$). The permeability (liquid-absorbing property) is rapidly improved beyond a point near the value (such as approximately 4 J/cm$^2$) where the decreasing pH value levels off. This phenomenon, however, varies depending on the polymer components contained in the ink.

As a result of these changes, the value of the beading (granularity) reaches a very good level after the permeability (liquid-absorbing property) starts improving (at the amount of plasma energy of, for example, approximately 4 J/cm$^2$). The term "beading (granularity)" used herein refers to a value numerically representing the roughness of an image, and represents a variation in the density as a standard deviation of mean densities. In FIG. 23, a plurality of densities of a solid image consisting of dots of two or more colors are sampled, and the standard deviation of the densities is represented as the beading (granularity). As described above, the ink ejected on the coated paper subjected to the plasma treatment according to the present embodiment permeates the coated paper while spreading in a perfect circular shape and being aggregated, so that the beading (granularity) of the image is improved.

As described above, in the relation between the surface properties of the treatment target 1020 and the image quality, the roundness of the dots improves as the wettability of the surface improves. This may be because an increase in surface roughness and the generation of the hydrophilic polar functional groups provided by the plasma treatment improve the wettability and uniformity thereof of the surface of the treatment target 1020. Another cause may be that the plasma treatment removes water-repellent factors, such as dirt, oil, and calcium carbonate, on the surface of the treatment target 1020. In other words, as a result of the improvement in the wettability of the surface of the treatment target 1020 and the removal of the destabilizing factors from the surface of the treatment target 1020, the ink droplets are considered to evenly spread in the circumferential direction thereof so as to improve the roundness of the dots.

The acidification (reduction in the pH value) of the surface of the treatment target 1020 causes, for example, the aggregation of the ink pigments, the improvement in the permeability, and the permeation of the vehicles into the coating layer 1021. These results increase the density of the pigments on the surface of the treatment target 1020, so that the pigments can be restrained from moving even if the dots coalesce together. As a result, the pigments can be restrained from mixing to cause turbidity, and can be evenly deposited and aggregated on the surface of the treatment target 1020. The effect of restraining the turbidity by the pigment mixture varies depending on the components of the ink and the size of the ink droplet. For example, when the size of the ink droplet is smaller, the pigments are less likely to be mixed to cause turbidity by the coalescence of the dots than in the case of a larger droplet size. This is because a vehicle having a smaller size is dried and permeates more quickly, and can aggregate the pigments with a smaller amount of pH reaction. The effect of the plasma treatment varies depending on the type of the treatment target 1020 and the environment (such as humidity). Hence, the amount of plasma energy in the plasma treatment may be controlled to an optimal value according to the volume of the droplets, the type of the treatment target 1020, and the environment. As a result, cases exist in which the efficiency of surface modification of the treatment target 1020 can be improved, and energy can be further saved.

Figure 24:
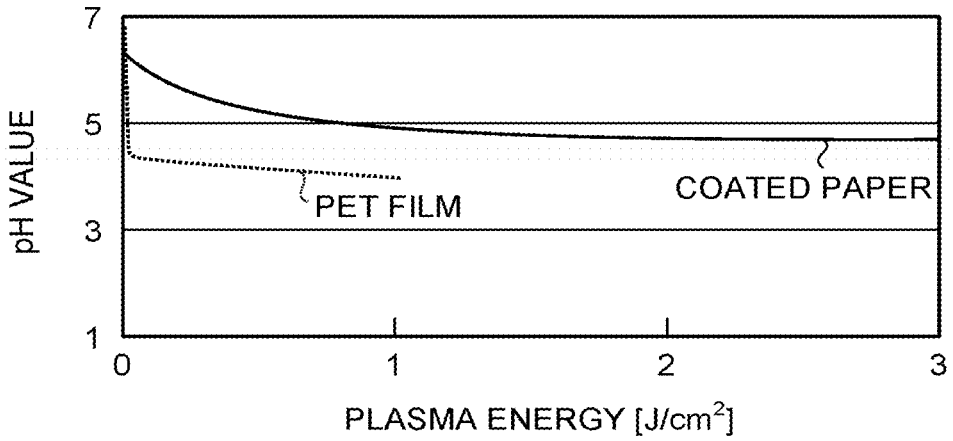
FIG. 24 is a diagram illustrating examples of relations for respective media each between the amount of plasma energy and the pH value of the treatment target surface according to the third embodiment.

FIG. 24 is a graph illustrating relations for respective media each between the amount of plasma energy and the pH value of the treatment target surface according to the third embodiment. The coated paper and a polyethylene terephthalate (PET) film are herein exemplified as the examples of media. While the pH value is generally measured in a liquid solution, a pH value of a solid surface can be measured in these years. A pH meter B-211 manufactured by HORIBA, Ltd. can be used as a measuring instrument for that purpose.

In FIG. 24, the solid line represents plasma energy dependence of the pH value of the coated paper, and the dotted line represents the plasma energy dependence of the pH value of the PET film. As illustrated in FIG. 24, the PET film is acidified at a lower amount of plasma energy than that for the coated paper. The coated paper was, however, also acidified at an amount of plasma energy of approximately 3 J/cm$^2$ or lower. When an image was recorded on the treatment target 1020 having a pH value of 5 or lower using an inkjet processing apparatus that ejects the alkaline aqueous pigment ink, dots of the formed image had a nearly perfect circular shape. No turbidity by mixture of pigments was generated by coalescence of the dots, and a good image without blur was obtained (refer to FIG. 21).

The following describes details of the image forming system according to the third embodiment with reference to the drawings.

In the third embodiment, an image forming apparatus will be described that includes ejection heads (recording heads or ink heads) for four colors of black (K), cyan (C), magenta (M), and yellow (Y). However, the present invention is not limited to such ejection heads.

Specifically, the image forming apparatus may further include ejection heads for green (G), red (R), and other colors, or may include only an ejection head for black (K). In the following description, K, C, M, and Y correspond to black, cyan, magenta, and yellow, respectively.

In the third embodiment, a continuous sheet wound in a roll shape (hereinafter, called a rolled sheet) is used as the treatment target. However, the treatment target is not limited to such sheet, but only needs to be a recording medium, such as a cut sheet, on which an image can be formed. If the treatment target is paper, various types of paper can be used, such as plain paper, high-quality paper, recycled paper, thin paper, thick paper, and coated paper. Examples of the recording medium usable as the treatment target also include, but are not limited to, a transparency sheet, a synthetic resin film, a metal thin film, and others on which surface an image can be formed with ink or the like. If the paper is non-permeable or low-permeable paper, such as the coated paper, the third embodiment provides greater effects. The rolled sheet may be a continuous sheet (continuous form sheet or sheet of continuous forms) that has perforations at certain intervals at which the sheet is separable. In that case, a page of the rolled sheet refers to, for example, an area between perforations provided at the certain intervals.

Figure 25:
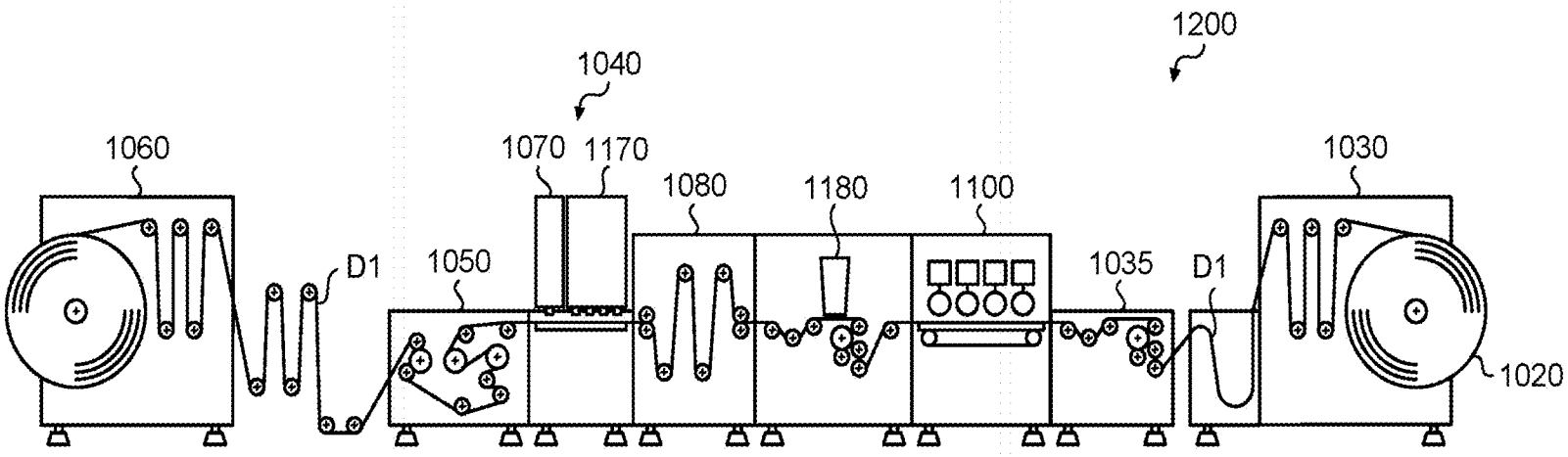
FIG. 25 is a schematic diagram illustrating a schematic configuration of an image forming system according to the third embodiment.

FIG. 25 is a schematic diagram illustrating a schematic configuration of a printer (image forming system) according to the third embodiment. As illustrated in FIG. 25, this image forming system 1200 includes a feeding unit 1030 for feeding (conveying) the treatment target 1020 (rolled sheet) along a conveying path D1, a plasma treatment apparatus 1100 for applying the plasma treatment as the pretreatment to the fed treatment target 1020, and an image forming apparatus 1040 for forming an image on the plasma-treated surface of the treatment target 1020. These apparatuses may lie in separate housings to constitute a system as a whole, or may constitute the printer contained in one housing. When the apparatuses are configured as a printing system, a control unit for controlling the whole or a part of the system may be included in any of the apparatuses, or may be provided in a separate independent housing.

When an image is formed in the image forming system 1200, the treatment target 1020 is conveyed as a whole in the direction from the right side to the left side in FIG. 25 serving as a sheet feeding direction. The direction of rotation of the rolled sheet (treatment target 1020) in this operation is referred to as a normal rotation direction.

An adjustment unit 1035 is provided between the feeding unit 1030 and the plasma treatment apparatus 1100, and adjusts the tension of the treatment target 1020 fed to the plasma treatment apparatus 1100. A buffer unit 1080 is provided between the plasma treatment apparatus 1100 and an inkjet recording apparatus 1170, and is used for adjusting the amount of feed of the treatment target 1020 that has been subjected to the pretreatment, such as the plasma treatment, to the inkjet recording apparatus 1170. The image forming apparatus 1040 includes the inkjet recording apparatus 1170 that forms an image on the plasma-treated treatment target 1020 by performing inkjet processing. The image forming apparatus 1040 may further include a posttreatment unit 1070 for posttreating the treatment target 1020 on which the image has been formed.

The image forming system 1200 may include a drying unit 1050 for drying the posttreated treatment target 1020, and also include a convey-out unit 1060 for conveying out the treatment target 1020 that has the image formed thereon (and has also been posttreated depending on the case). The image forming system 1200 may also include, as a pretreatment unit for pretreating the treatment target 1020, a precoating unit (not illustrated) for applying a treatment liquid called a precoating agent containing polymer material to the surface of the treatment target 1020, in addition to the plasma treatment apparatus 1100. The image forming system 1200 may also be provided, between the plasma treatment apparatus 1100 and the image forming apparatus 1040, with a pH detection unit 1180 for detecting the pH value of the surface of the treatment target 1020 after being pretreated by the plasma treatment apparatus 1100.

The image forming system 1200 further includes a control unit (not illustrated) for controlling operations of the units. The control unit may be connected to a print control device that generates raster data from, for example, image data to be printed. The print control device may be provided in the image forming system 1200, or may be provided outside and connected via a network, such as the Internet or a local area network (LAN).

As described above, in the third embodiment, the image forming system 1200 illustrated in FIG. 25 performs the acidification treatment of acidifying the surface of the treatment target before the inkjet recording process. The acidification treatment can employ, for example, an atmospheric pressure nonequilibrium plasma treatment using a dielectric barrier discharge. In the acidification treatment using the atmospheric pressure nonequilibrium plasma, the electron temperature is very high, and the gas temperature is around room temperature, so that the atmospheric pressure nonequilibrium plasma treatment is a preferable method for applying the plasma treatment to the treatment target, such as the recording medium.

To generate the atmospheric pressure nonequilibrium plasma in a stable manner over a wide range, the dielectric barrier discharge based on a streamer breakdown is preferably employed in the atmospheric pressure nonequilibrium plasma treatment. The dielectric barrier discharge based on the streamer breakdown can be produced, for example, by applying a high alternating voltage between electrodes coated with a dielectric material.

In addition to the dielectric barrier discharge based on the streamer breakdown, various methods can be used as a method for generating the atmospheric pressure nonequilibrium plasma. Examples of the employable method include, but are not limited to, a dielectric barrier discharge produced by inserting an insulator such as a dielectric material between electrodes, a corona discharge produced by generating a highly non-uniform electric field on a thin metal wire or the like, and pulsed discharges produced by applying short-pulse voltages. Two or more of these methods may also be combined.

Figure 26:
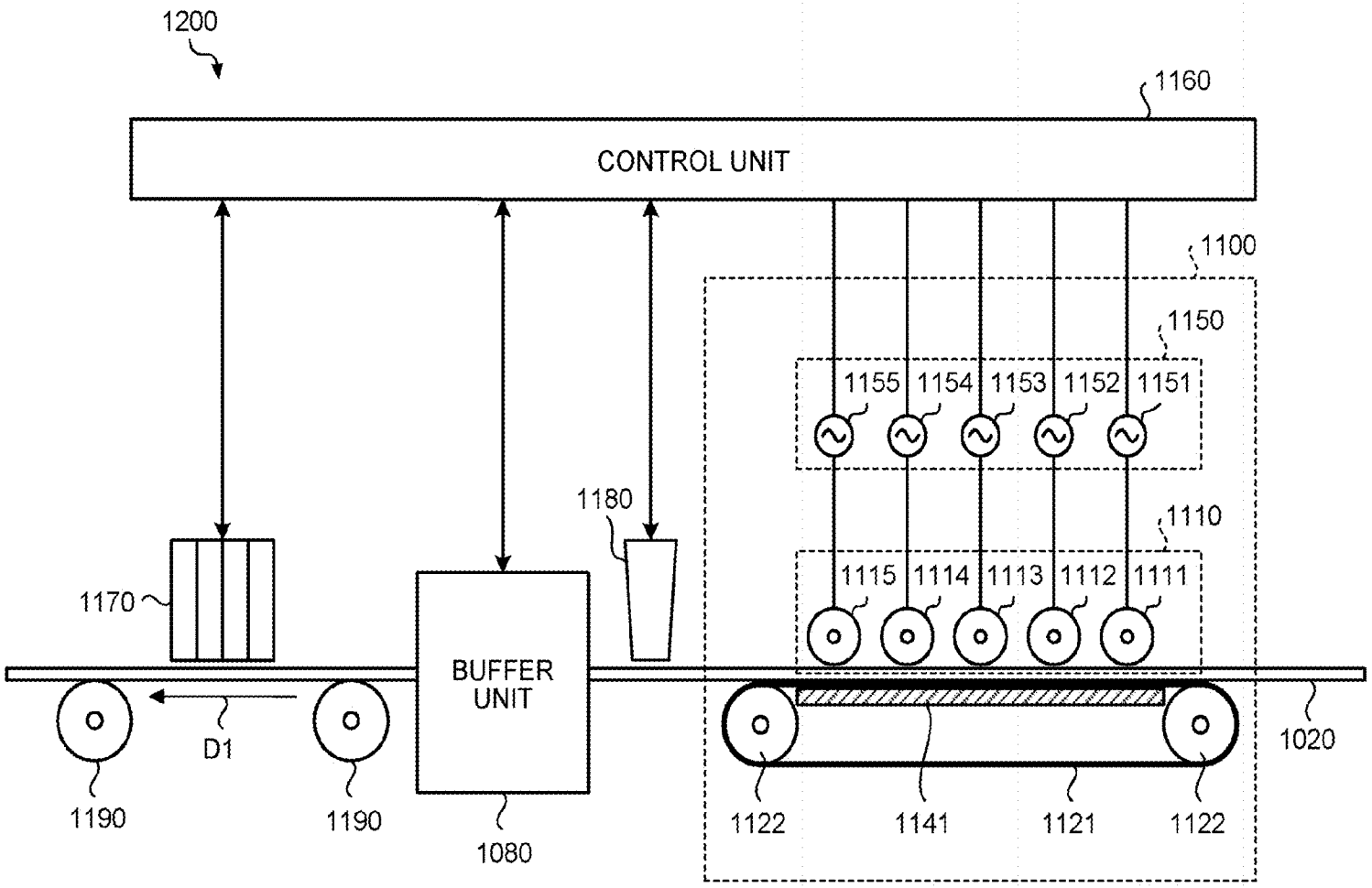
FIG. 26 is a schematic diagram illustrating a configuration of a portion ranging from a plasma treatment apparatus to an inkjet recording apparatus extracted from the image forming system according to the third embodiment.

FIG. 26 illustrates the configuration of a portion ranging from the plasma treatment apparatus 1100 to the inkjet recording apparatus 1170 extracted from the image forming system 1200 illustrated in FIG. 25. As illustrated in FIG. 26, the image forming system 1200 includes the plasma treatment apparatus 1100 for plasma-treating the surface of the treatment target 1020, the pH detection unit 1180 for measuring the pH value of the surface of the treatment target 1020, the buffer unit 1080 that adjusts the amount of feed of the treatment target 1020 conveyed out of the plasma treatment apparatus 1100, the inkjet recording apparatus 1170 for forming an image on the treatment target 1020 using the inkjet recording process, and a control unit 1160 for controlling the entire image forming system 1200. The image forming system 1200 also includes conveying rollers 1190 for conveying the treatment target 1020 along the conveying path D1. The conveying rollers 1190 convey the treatment target 1020 along the conveying path D1, for example, by rotationally driving the treatment target 1020 according to the control by the control unit 1160.

In a similar manner to the case of the plasma treatment apparatus 1010 illustrated in FIG. 18, the plasma treatment apparatus 1100 includes a discharge electrode 1110, a counter electrode 1141, a high-frequency high-voltage power supply 1150, and a dielectric belt 1121 interposed between the electrodes. In FIG. 26, the discharge electrode 1110 includes five discharge electrodes 1111 to 1115, and the counter electrode 1141 is provided over the entire area facing the discharge electrodes 1111 to 1115 with the dielectric belt 1121 interposed between the counter electrode 1141 and the discharge electrodes 1111 to 1115. The high-frequency high-voltage power supply 1150 including five high-frequency high-voltage power supplies 1151 to 1155, the number thereof corresponding to that of the discharge electrodes 1111 to 1115.

In order to be used also for conveying the treatment target 1020, the dielectric belt 1121 is preferably an endless belt. Accordingly, the plasma treatment apparatus 1100 further includes rotating rollers 1122 for conveying the treatment target 1020 by circulating the dielectric belt 1121. The rotating rollers 1122 rotate based on a command from the control unit 1160 so as to drive the dielectric belt 1121 to circulate. This operation conveys the treatment target 1020 along the conveying path D1.

The control unit 1160 can individually turn on and off the high-frequency high-voltage power supplies 1151 to 1155. The control unit 1160 can also adjust the pulse intensities of high-frequency high-voltage pulses supplied by the high-frequency high-voltage power supplies 1151 to 1155 to the discharge electrodes 1111 to 1115, respectively.

The pH detection unit 1180 is placed downstream of the plasma treatment apparatus 1100 and the precoating unit (not illustrated). The pH detection unit 1180 may detect the pH value of the surface of the treatment target 1020 pretreated (acidified) by the plasma treatment apparatus 1100 and/or the precoating unit, and supply the detected pH value into the control unit 1160. In response, the control unit 1160 may perform feedback control of the plasma treatment apparatus 1100 and/or the precoating unit (not illustrated) based on the pH value received from the pH detection unit 1180 so as to adjust the pH value of the pretreated surface of the treatment target 1020.

The amount of plasma energy required for the plasma treatment can be obtained, for example, from the voltage value and the application time of the high-frequency high-voltage pulses supplied from the high-frequency high-voltage power supplies 1151 to 1155 to the discharge electrodes 1111 to 1115, respectively, and the current that has flowed into the treatment target 1020 during the application time. The amount of plasma energy required for the plasma treatment may be controlled as an amount of energy of the discharge electrode 1110 as a whole, instead of as that of each of the discharge electrodes 1111 to 1115.

The treatment target 1020 is plasma-treated by passing between the discharge electrode 1110 and the dielectric belt 1121 while the plasma treatment apparatus 1100 is generating the plasma. This process breaks chains of a binder resin on the surface of the treatment target 1020, and further recombines the oxygen radicals and the ozone in the gas phase with the polymers so as to generate the polar functional groups on the surface of the treatment target 1020. As a result, the hydrophilicity and the acidity are given to the surface of the treatment target 1020. While the plasma treatment is performed in the air atmosphere in the present example, the plasma treatment may be applied in a gas atmosphere, such as a nitrogen or noble gas atmosphere.

Providing a plurality of discharge electrodes, that is, the discharge electrodes 1111 to 1115 is also effective for uniformly acidifying the surface of the treatment target 1020. Specifically, for example, assuming the same conveying speed (or printing speed), the treatment target 1020 can take a longer time to pass through the space containing the plasma in the case of being acidified using a plurality of discharge electrodes than in the case of being acidified using one discharge electrode. As a result, the surface of the treatment target 1020 can be more uniformly acidified.

The treatment target 1020 plasma-treated in the plasma treatment apparatus 1100 is conveyed into the inkjet recording apparatus 1170 via the buffer unit 1080. The inkjet recording apparatus 1170 includes an inkjet head. The inkjet head includes, for example, a plurality of sets of the same color heads (such as 4 colors×4 heads) for obtaining a higher printing speed. To form a high-resolution image (at, for example, 1200 dpi) at a higher speed, the ink ejection nozzles of the heads for each of the colors are fixed in positions shifted from one another so as to provide correct distances therebetween. In addition, the inkjet head can be driven at any of a plurality of driving frequencies so that dots (droplets) ejected from each of the nozzles can have any of the three types of volumes called the large, medium, and small droplet sizes.

The inkjet head is placed downstream of the plasma treatment apparatus 1100 in the conveying path D1 of the treatment target 1020. Under the control of the control unit 1160, the inkjet recording apparatus 1170 performs the image formation by ejecting ink onto the treatment target 1020 pretreated (acidified) by the plasma treatment apparatus 1100.

The inkjet head of the inkjet recording apparatus 1170 may include the sets of the same color heads (4 colors×4 heads) as illustrated in FIG. 26. This configuration can increase the speed of the inkjet recording process. In this case, for example, to obtain the resolution of 1200 dpi at a higher speed, the heads of each of the colors in the inkjet head are fixed in positions shifted from one another so as to provide correct distances between the nozzles for ejecting the ink. In addition, drive pulses having several varieties of drive frequencies are supplied to the heads of each of the colors so that the dots ejected from each of the nozzles of the heads can have the three types of volumes called the large, medium, and small droplet sizes.

Providing a plurality of discharge electrodes, that is, the discharge electrodes 1111 to 1115 is also effective for uniformly plasma-treating the surface of the treatment target 1020. Specifically, for example, assuming the same conveying speed (or printing speed), the treatment target 1020 can take a longer time to pass through the space containing the plasma in the case of being plasma-treated using a plurality of discharge electrodes than in the case of being plasma-treated using one discharge electrode. As a result, the surface of the treatment target 1020 can be more uniformly plasma-treated.

In the configuration described above, if the image formation in a plasma-treated region of the treatment target 1020 is not completed within a certain time after the treatment target 1020 is plasma-treated in the plasma treatment apparatus 1100, the image forming system 1200 returns the treatment target 1020 so that the surface-treated region reaches a position at least before the plasma treatment apparatus 1100 (such as the position of the adjustment unit 1035). The image forming system 1200 then conveys the treatment target 1020 along the conveying path D1, then applies the plasma treatment again in the plasma treatment apparatus 1100, and thereafter, performs the image formation in the image forming apparatus 1040.

Figure 27:
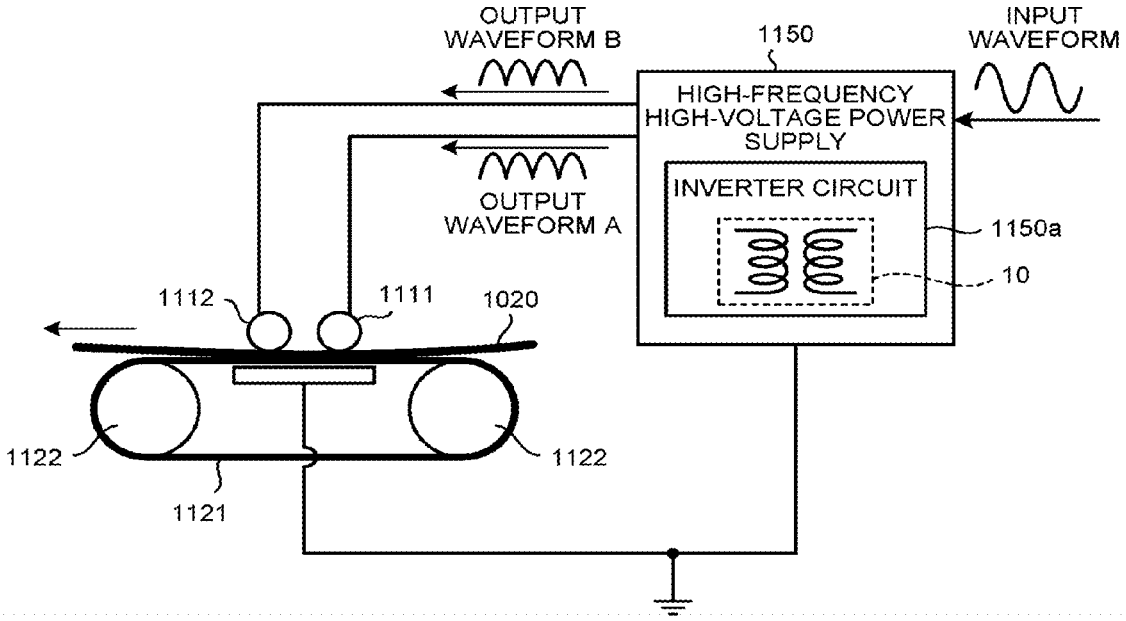
FIG. 27 is a schematic diagram illustrating an example of the schematic configuration of the plasma treatment apparatus according to the third embodiment.

FIG. 27 is a schematic diagram illustrating an example of the schematic configuration of the plasma treatment apparatus usable in the third embodiment. Each of the discharge electrodes 1111 and 1112 illustrated in FIG. 27 may be an electrode with a metal portion thereof exposed, or may have the metal portion coated with, for example, a dielectric material or an insulating material made of, for example, insulating rubber or ceramic.

The third embodiment has a configuration in which each of the discharge electrodes 1111 and 1112 has a sectional shape of a roller, and is in contact with the treatment target 1020 so as to rotate along with the conveyance of the treatment target 1020. The configuration is not limited to this. For example, the configuration may be such that the discharge electrodes 1111 and 1112 are apart from the treatment target 1020 by several millimeters. In that case, the sectional shape of each of the discharge electrodes 1111 and 1112 may be an elongated shape such as a wire shape, or may be a substantially triangular blade-like shape tapering off toward the counter electrode 1141.

The high-frequency high-voltage power supply 1150 includes an inverter circuit 1150*a* that uses the resonant circuit 1 illustrated in FIG. 1. The high-frequency high-voltage power supply 1150 uses the transformer 10 to raise an alternating voltage (input waveform) supplied from an alternating-current power supply, and further rectifies the raised alternating voltage so as to generate high-frequency high-voltage pulses (output waveforms A and B), which in turn are applied to the discharge electrodes 1111 and 1112.

Figure 28:
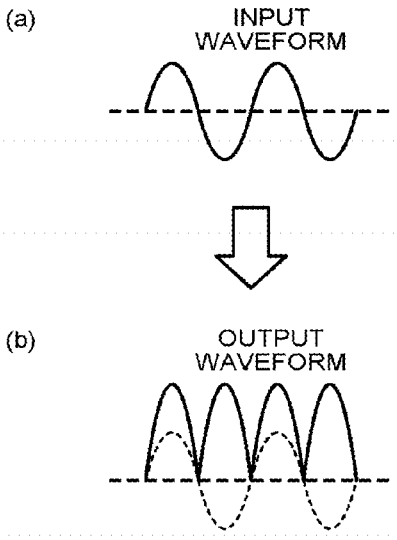
FIG. 28 is a diagram illustrating examples of an input waveform and an output waveform of voltage pulses to and from a high-frequency high-voltage power supply according to the third embodiment.

FIG. 28 is a diagram illustrating examples of the input waveform and the output waveform of the voltage pulses to and from the high-frequency high-voltage power supply. As illustrated at (a) in FIG. 28, the high-frequency high-voltage power supply 1150 is supplied with an AC voltage waveform that is a sinusoidal alternating waveform as the input waveform. As illustrated at (b) in FIG. 28, the high-frequency high-voltage power supply 1150 uses the transformer 10 to raise the voltage of the supplied input waveform, converts the result into positive voltage waveforms using, for example, a rectifying circuit, and then, outputs the positive voltage waveforms as the output waveforms.

In the third embodiment, the high-frequency high-voltage power supply 1150 uses the transformer 10 according to any of the first embodiment, the modifications of the first embodiment, the second embodiment, and the modification of the second embodiment. Consequently, the inverter circuit 1150*a* can operate at a higher switching frequency, and thus can efficiently generate a higher voltage. The water molecules are eliminated from the interior of the container (shell) of the transformer 10. Hence, the leakage and the electric discharge caused by the water molecules are reduced, so that the high-frequency high-voltage power supply 1150 is improved in reliability. Moreover, the transformer 10 is sealed. Hence, changes in the external environment are restrained from affecting the interior of the container, so that the high-frequency high-voltage power supply 1150 can operate in a stable manner in various environments that are different in weather or altitude.

An embodiment provides an advantageous effect that a transformer can have a higher self-resonant frequency.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A transformer, comprising:

a first winding;

a second winding provided to maintain a first distance to the first winding; and a shell that seals the first winding and the second winding; wherein the shell is sealed after water molecules therein are reduced, and the shell is sealed after an air pressure therein is reduced to a vacuum state at an air pressure of $10^{-1}$ pascal (Pa) or lower than an atmospheric pressure.

2. A plasma generator, comprising:

the transformer according to claim 1;

an inverter circuit including the transformer serving as a voltage conversion unit; and a plasma generating unit that uses an output voltage of the inverter circuit to generate a plasma.

3. A transformer, comprising:

a first winding;

a second winding provided around an outer circumference of the first winding to maintain a first distance to the first winding in a radial direction thereof;

a shell that seals the first winding and the second winding;

a first bridge that has a thickness equal to the first distance in the radial direction of the first winding, and that is provided on a part of the outer circumference of the first winding between the first and the second windings; and a second bridge that has a thickness equal to a second distance in the radial direction of the second winding, and that is provided on a part of the outer circumference of the second winding between the second winding and the shell, wherein the shell sealingly contains the first and the second windings with the second distance provided from an outer circumference of the second winding in a radial direction of the second winding.

4. The transformer according to claim 3, further comprising a core provided inside the first winding.

5. A plasma generator, comprising:

the transformer according to claim 3;

an inverter circuit including the transformer serving as a voltage conversion unit; and a plasma generating unit that uses an output voltage of the inverter circuit to generate a plasma.

6. A transformer, comprising:

a first winding;

a second winding provided to maintain a first distance to the first winding; and a shell that seals the first winding and the second winding, wherein each of the first and the second windings is formed by a plurality of whirling patterns that are formed on a plurality of layers included in a multilayer board in which layers made of a conductor and an insulating material are stacked, and that do not overlap each other between adjacent first and second layers in a stacking direction of the multilayer board.

7. The transformer according to claim 6, wherein each of the windings is formed by connecting together a first whirling pattern formed on the first layer and a second whirling pattern formed on the second layer among the whirling patterns via a via-hole without having a portion overlapping in the stacking direction of the multilayer board.

8. The transformer according to claim 7, wherein each of the windings is formed by connecting the first and the second whirling patterns between ends at outermost circumferences thereof or between ends at innermost circumferences thereof via a via-hole.

9. The transformer according to claim 6, wherein the whirling patterns are not formed on outer layers of the multilayer board.

10. The transformer according to claim 7, wherein a third layer from which a conductor at least in a region corresponding to the first and the second whirling patterns is removed is provided between the first layer with the first whirling pattern formed thereon and the second layer with the second whirling pattern formed thereon.

11. The transformer according to claim 10, wherein the third layer includes a space in the region.

12. The transformer according to claim 6, wherein each of the whirling patterns is a spiral whirling pattern in which turns of the pattern are arranged at regular intervals in a radial direction thereof.

13. A plasma generator, comprising:

the transformer according to claim 6;

an inverter circuit including the transformer serving as a voltage conversion unit; and a plasma generating unit that uses an output voltage of the inverter circuit to generate a plasma.

* * * * *